US010216123B2

(12) United States Patent
Hori et al.

(10) Patent No.: US 10,216,123 B2
(45) Date of Patent: Feb. 26, 2019

(54) DEVELOPING DEVICE

(71) Applicant: CANON KABUSHIKI KAISHA, Tokyo (JP)

(72) Inventors: Takuya Hori, Kashiwa (JP); Naoki Mugita, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/925,900

(22) Filed: Mar. 20, 2018

(65) Prior Publication Data

US 2018/0284655 A1 Oct. 4, 2018

(30) Foreign Application Priority Data

Mar. 30, 2017 (JP) ..... 2017-068772
Mar. 30, 2017 (JP) ..... 2017-068780

(51) Int. Cl.
*G03G 15/08* (2006.01)
*G03G 15/16* (2006.01)

(52) U.S. Cl.
CPC ..... *G03G 15/167* (2013.01); *G03G 15/0808* (2013.01); *G03G 15/0865* (2013.01)

(58) Field of Classification Search
CPC ..... G03G 15/0921; G03G 15/0812; G03G 15/09; G03G 15/0928
See application file for complete search history.

(56) References Cited

U.S. PATENT DOCUMENTS 9,244,376 B2 1/2016 Kuramoto et al.
9,268,263 B2 2/2016 Ariizumi et al.
2011/0123234 A1* 5/2011 Terai ..... G03G 15/0921 399/273
2012/0148313 A1* 6/2012 Nose ..... G03G 15/0815 399/269

(Continued)

FOREIGN PATENT DOCUMENTS

JP 2015-072331 A 4/2015

OTHER PUBLICATIONS

Ryohei Terada et al., U.S. Appl. No. 15/873,261, filed Jan. 17, 2018.

(Continued)

*Primary Examiner* — Walter L Lindsay, Jr.
*Assistant Examiner* — Jessica L Eley
(74) *Attorney, Agent, or Firm* — Venable LLP

(57) ABSTRACT

A developing device includes an accommodating casing, a rotatable developer carrying member, a regulating portion, a magnetic flux generating portion including a first magnetic pole and a second magnetic pole which have the same polarity, and a cover portion provided downstream of the developing region and upstream of a maximum magnetic flux density position of the second magnetic pole with respect to a rotational direction of the developer carrying member. The cover portion is disposed between the casing and the developer carrying member. As measured in the rotational axis direction, a dimension of the cover portion at an upstream end with respect to the rotational direction is smaller than a dimension of the cover portion in at least a region positioned downstream of the upstream end with respect to the rotational direction.

16 Claims, 15 Drawing Sheets

(56) References Cited

U.S. PATENT DOCUMENTS

2015/0016848 A1* 1/2015 Ishii ..... G03G 15/0896
399/279

OTHER PUBLICATIONS

Masafumi Takahashi et al., U.S. Appl. No. 15/926,107, filed Mar. 20, 2018.
Masafumi Takahashi et al., U.S. Appl. No. 15/925,913, filed Mar. 20, 2018.
Yukihiro Soeta et al., U.S. Appl. No. 15/926,169, filed Mar. 20, 2018,
Koji Shigehiro et al., U.S. Appl. No. 15/729,950, filed Oct. 11, 2017.

* cited by examiner (a)

(b)

(a)

(b)

DEVELOPING DEVICE

FIELD OF THE INVENTION AND RELATED ART

The present invention relates to a developing device including a developer carrying member rotatable while carrying a developer, and relates to an image forming apparatus, including the developing device, such as a copying machine, a printer, a facsimile machine or a multifunction machine having a plurality of functions of these machines.

An image forming apparatus of an electrophotographic type or an electrostatic recording type includes a developing device for developing an electrostatic latent image, with a developer such as toner, formed on a photosensitive drum as an image bearing member. The developing device includes a developing sleeve as a developer carrying member rotatable while carrying a developer and supplies, to the photosensitive drum, the developer carried on the developing sleeve.

In the case of such a developing device, there is a liability that air flows into a developing container constituting the developing device due to rotation of the developing sleeve and atmospheric pressure in the developing container increases and thus the developer in the developing container is scattered to an outside of the developing container. For this reason, a constitution in which an inner cover is provided between an outer cover of the developing container and the developing sleeve and the air flowing from between the developing sleeve and the inner cover into the developing container is discharged through between the inner cover and the outer cover has been proposed (Japanese Laid-Open Patent Application (JP-A) 2015-72331).

However, in the case of the constitution disclosed in JP-A 2015-72331, there is a liability that the air containing the developer is discharged, to the outside of the developing container, from an inflow path, between the pressure and the inner cover, for permitting flowing of the air into the developing container. Particularly, the developer scattered from both end portions of the developing container with respect to an axial direction (rotational axis direction) of the developer carrying member is liable to flow into a periphery of the developing container, so that, there is a possibility that scattering of the developer cannot be sufficiently suppressed.

SUMMARY OF THE INVENTION

A principal object of the present invention is to provide a developing device capable of sufficiently suppressing scattering of a developer from both end portions of a developing container with respect to a rotational axis direction of a developer carrying member.

According to an aspect of the present invention, there is provided a developing device comprising: an accommodating casing configured to accommodate a developer; a rotatable developer carrying member provided in the accommodating casing and configured to develop, in a developing region, an electrostatic latent image formed on an image bearing member; a regulating portion provided below the developer carrying member with respect to a vertical direction and configured to regulate an amount of the developer on the developer carrying member; a magnetic flux generating portion provided inside the developer carrying member and including a first magnetic pole provided downstream of the developing region with respect to a rotational direction of the developer carrying member and a second magnetic pole which is provided adjacently downstream of the first magnetic pole with respect to the rotational direction and which has a polarity identical to a polarity of the first magnetic pole; and a cover portion provided downstream of the developing region and upstream of a maximum magnetic flux density position of the second magnetic pole with respect to the rotational direction, the cover portion being disposed between the casing and the developer carrying member over a rotational axis direction of the developer carrying member with a gap between itself and the casing and with a gap between itself and the developer carrying member, wherein as measured in the rotational axis direction, a dimension of the cover portion at an upstream end with respect to the rotational direction is smaller than a dimension of the cover portion in at least a region positioned downstream of the upstream end with respect to the rotational direction.

Further features of the present invention will become apparent from the following description of exemplary embodiments with reference to the attached drawings.

Figure 13:
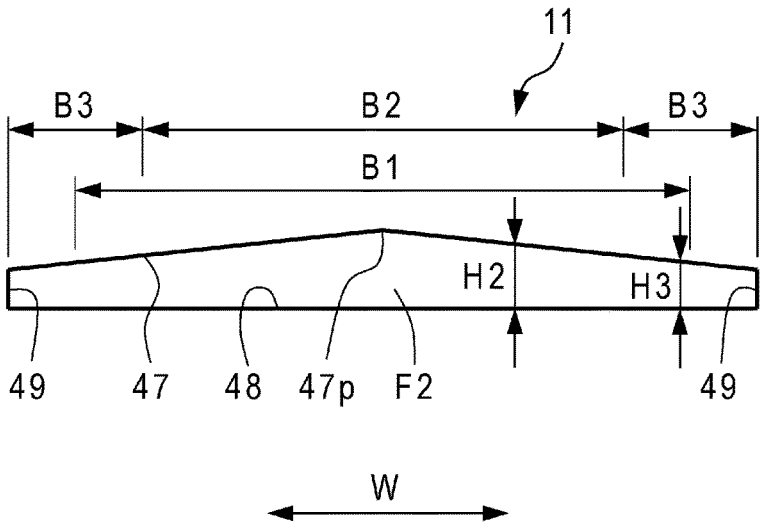
Figure 13:
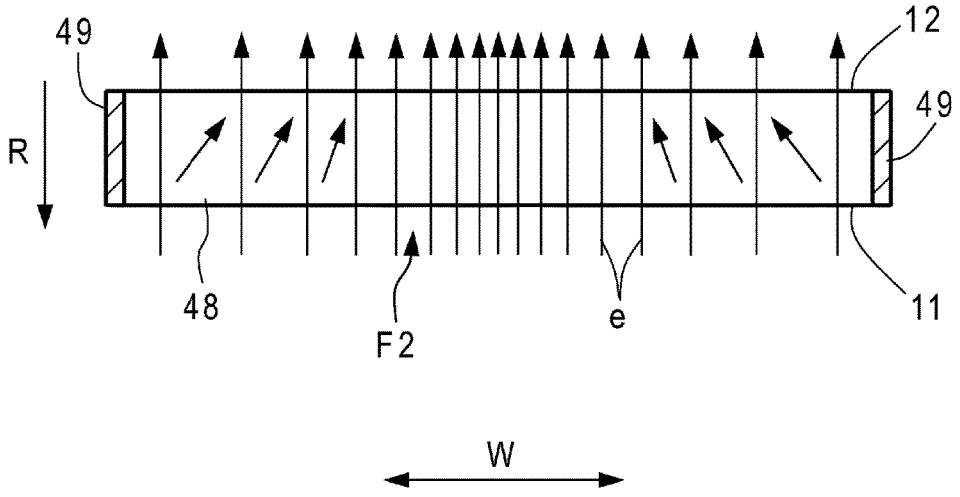

Parts (a) and (b) of FIG. 13 are schematic views for illustrating air streams at an inlet port of a second gap of the developing device in the First Embodiment, in which (a) is the schematic view as seen in an air flowing direction, and (b) is the schematic view as seen in a direction perpendicular to the flowing direction and a widthwise direction.

Figure 14:
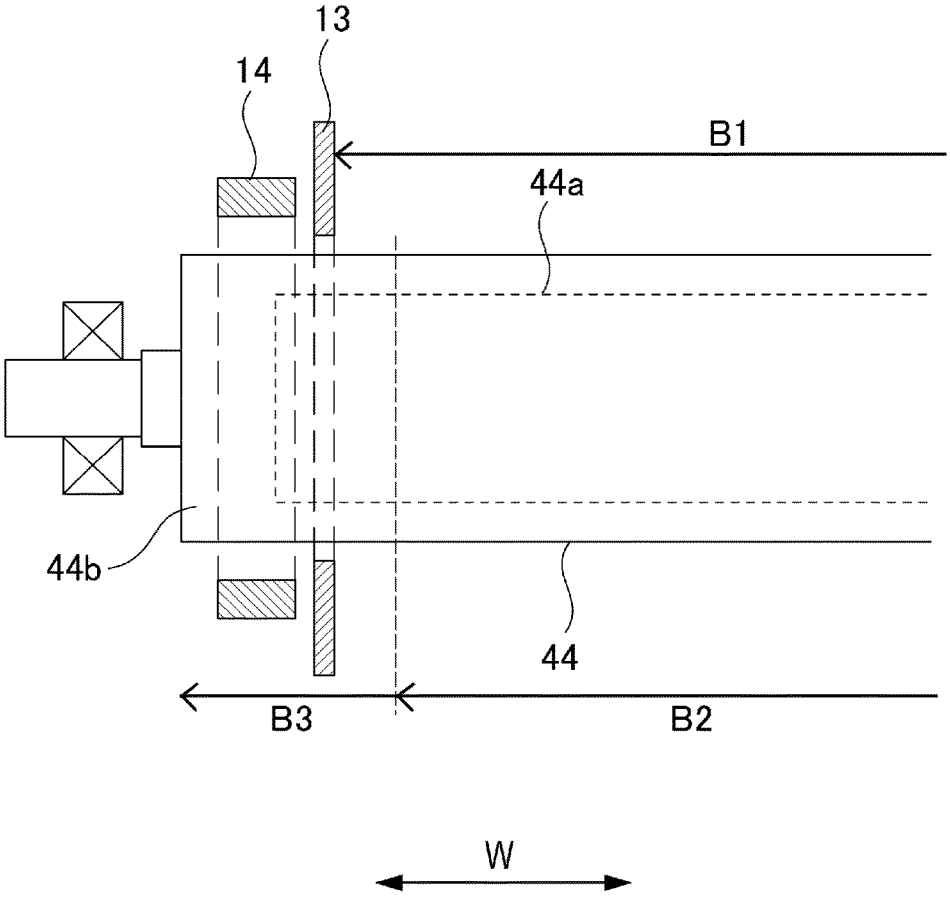

FIG. 14 is a sectional view showing an end portion of the developing sleeve of the developing device in the Third Embodiment.

Figure 15:
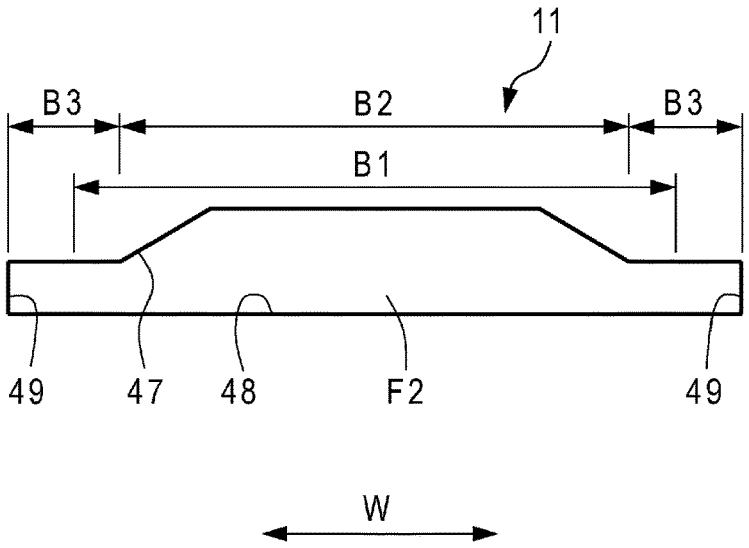
Figure 15:
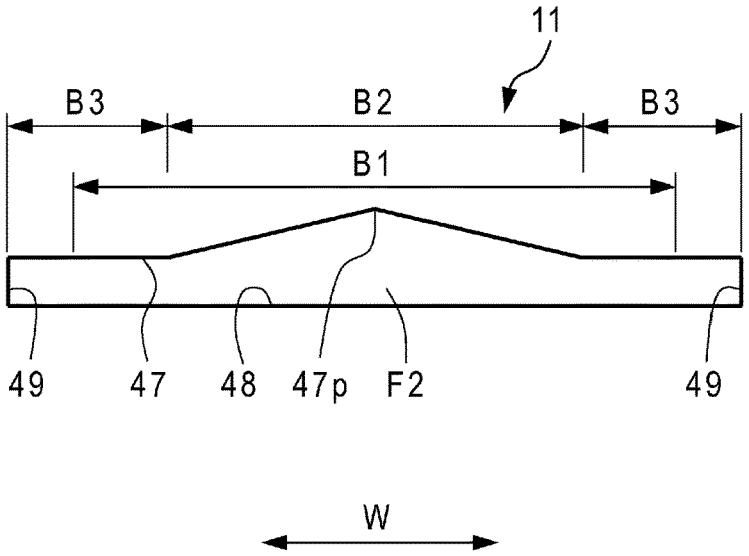

Parts (a) and (b) of FIG. 15 are sectional views each showing a modified example of the second gap of the developing device, in which (a) shows the case where heights of an inner cover at both end regions are substantially the same, and a height of the inner cover at a central region is substantially the same, and (b) shows the case where heights of an inner cover at both end regions are substantially the same, but a height at a central region has a maximum (peak) at a center of the central region.

DESCRIPTION OF EMBODIMENTS

First Embodiment

The First Embodiment will be described with reference to FIGS. 1 to 7. First, a general structure of an image forming apparatus in this embodiment will be described using FIGS. 1 and 2.

[Image Forming Apparatus]

An image forming apparatus 100 in this embodiment is a tandem(-type) full-color printer of an electrophotographic type, in which four image forming portions PY, PM, PC and PK each including a photosensitive drum 1 as an image bearing member are provided. The image forming apparatus 100 forms a toner image (image) on a recording material depending on an image signal from a host device such as an original reading device (not shown) connected with an apparatus main assembly 100A or a personal computer communicatably connected with the apparatus main assembly 100A. As the recording material, a sheet material such as a sheet, a plastic film or a cloth can be cited. Further, the image forming portions PY, PM, PC and PK form toner images of yellow, magenta, cyan and black, respectively.

The four image forming portions PY, PM, PC and PK provided in the image forming apparatus 100 have the substantially same constitution except that colors of developers are different from each other. Accordingly, the image forming portion PY will be described as a representative and other image forming portions will be omitted from description.

Figure 2:
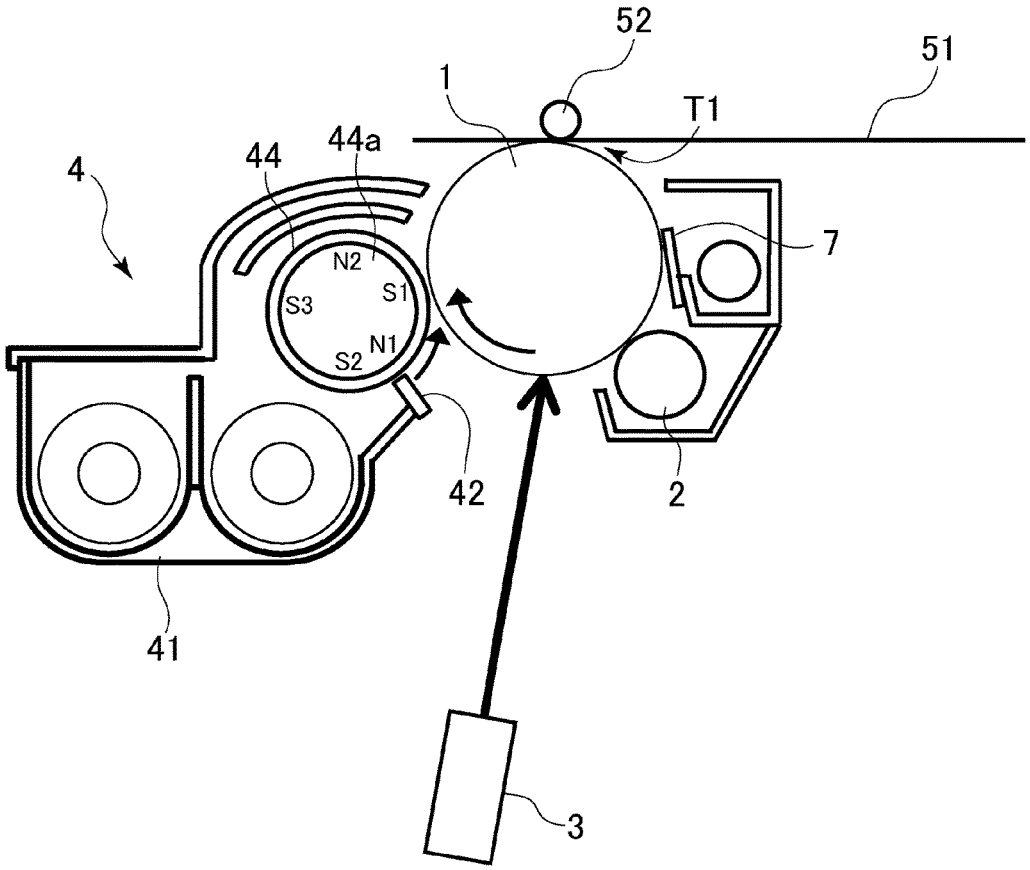
FIG. 2 is a schematic sectional view of an image forming portion in the First Embodiment.

As shown in FIG. 2, at the image forming portion PY, a cylindrical photosensitive member as the image bearing member, i.e., the photosensitive drum 1 is provided. The photosensitive drum 1 is rotationally driven in an arrow direction in the figure. At a periphery of the photosensitive drum 1, a charging roller 2 as a charging means, a developing device 4, a primary transfer roller 52 as a transfer means, and a cleaning device as a cleaning means are provided. Below the photosensitive drum 1 in the figure, an exposure device (a laser scanner in this embodiment) 3 as an exposure means is provided.

Figure 1:
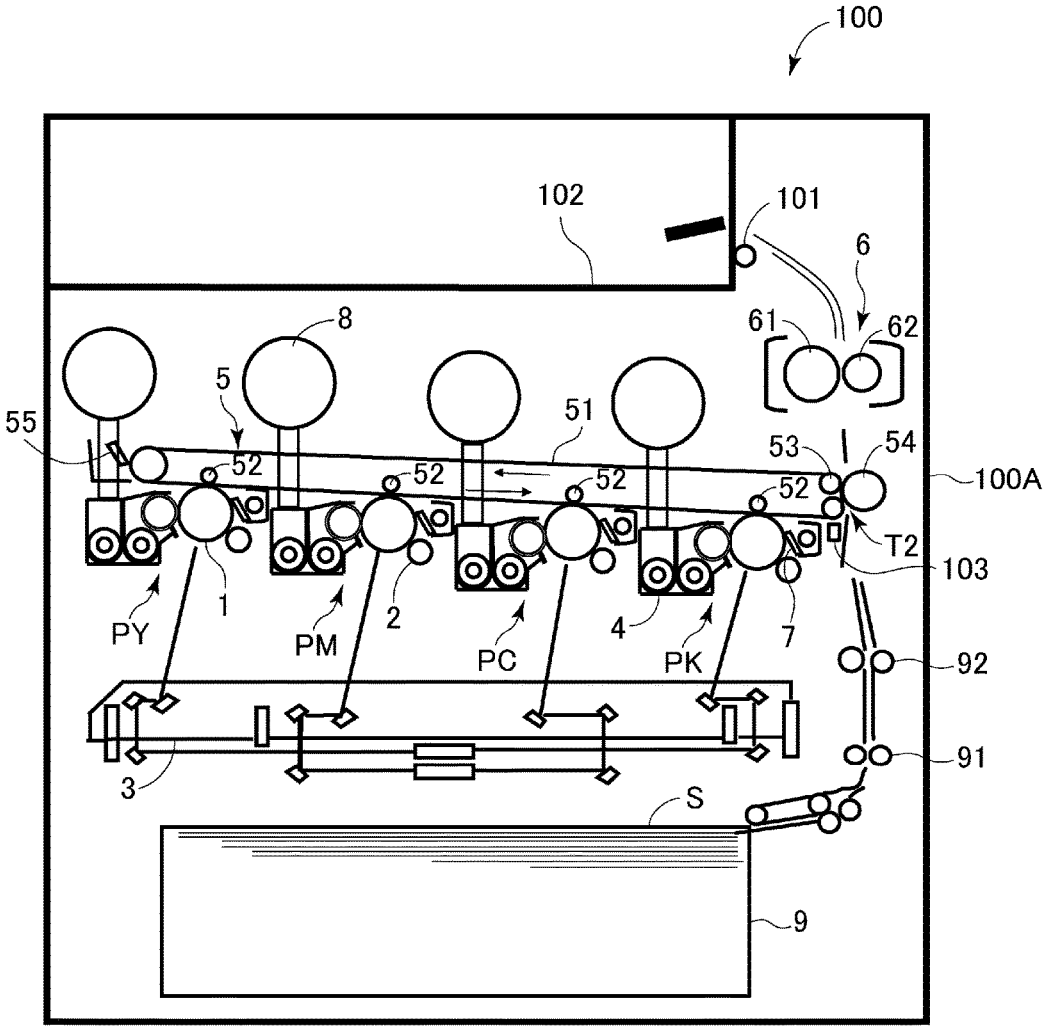
FIG. 1 is a schematic sectional view of an image forming apparatus according to a First Embodiment.

Above the respective image forming portions in FIG. 1, a transfer device 5 is provided. In the transfer device 5, an endless intermediary transfer belt 51 as an intermediary transfer member is stretched by a plurality of rollers and is constituted so as to be circulated (rotated) in an arrow direction. The intermediary transfer belt 51 carries and feeds the toner images which are primary-transferred on the intermediary transfer belt 51 as described later. At a position opposing an inner secondary transfer roller 53, of the rollers stretching the intermediary transfer belt 51, while sandwiching the intermediary transfer belt 51 between itself and the inner secondary transfer roller 53, an outer secondary transfer roller 54 as a secondary transfer means is provided and constitutes a secondary transfer portion T2 for transferring the toner images from the intermediary transfer belt 51 onto the recording material. A fixing device 6 is provided downstream of the secondary transfer portion T2 with respect to a recording material feeding direction.

At a lower portion of the image forming apparatus 100, a cassette 9 in which the recording material S is accommodated. The recording material S fed from the cassette 9 is fed toward a registration roller pair 92 by a feeding roller pair 91. A leading end of the recording material S abuts against the registration roller pair 92 which is in a rest state, and forms a loop, so that oblique movement of the recording material S is corrected. Thereafter, rotation of the registration roller pair 92 is started in synchronism with the toner images on the intermediary transfer belt 51, so that the recording material S is fed to the secondary transfer portion T2.

A process of forming, for example, a four-color-based full-color image by the image forming apparatus 100 constituted as described above will be described. First, when an image forming operation is started, a surface of a rotating photosensitive drum 1 is electrically charged uniformly by the charging roller 2. Then, the photosensitive drum 1 is exposed to laser light, corresponding to an image signal, emitted from the exposure device 3. As a result, an electrostatic latent image corresponding to the image signal is formed on the photosensitive drum 1. The electrostatic latent image on the photosensitive drum 1 is visualized by toner as the developer accommodated in the developing device 4 and is formed in a visible image (toner image).

The toner image formed on the photosensitive drum 1 is primary-transferred onto the intermediary transfer belt 51 at a primary transfer portion T1 (FIG. 2) constituted between the photosensitive drum 1 and a primary transfer roller 52 provided while sandwiching the intermediary transfer belt 51 between itself and the photosensitive drum 1. At this time, to the primary transfer roller 52, a primary transfer bias is applied. Toner (transfer residual toner) remaining on the surface of the photosensitive drum 1 after the primary transfer is removed by the cleaning device 7.

Such an operation is successively performed at the respective image forming portions for yellow, magenta, cyan and black, so that the four color toner images are superposed on the intermediary transfer belt 51. Thereafter, in synchronism with timing of toner image formation, the recording material S accommodated in the cassette 9 is fed to the secondary transfer portion T2. Then, by applying a secondary transfer bias to the outer secondary transfer roller 54, the four color toner images are secondary-transferred altogether from the intermediary transfer belt 51 onto the recording material S. Toner remaining on the intermediary transfer belt 51 without being completely transferred onto the recording material S at the secondary transfer portion T2 is removed by an intermediary transfer belt cleaner 55.

Then, the recording material S is fed to the fixing device 6 as a fixing means. In the fixing device 6, a fixing roller 61 including a heat source such as a halogen heater and a pressing roller 62 are provided, and a fixing nip is formed by the fixing roller 61 and the pressing roller 62. The recording material S on which the toner recording materials are transferred is passed through the fixing nip, so that the recording material S is heated and pressed. Then, the toners on the recording material S are melted and mixed with each other and are fixed as a full-color image on the recording material S. Thereafter, the recording material S is discharged onto a discharging tray 102 by a discharging roller 101. As a result, a series of image forming process operations is ended.

Incidentally, the image forming apparatus 100 in this embodiment is also capable of forming a single-color image, such as a back (monochromatic) image, or a multi-color image by using the image forming portion(s) for a desired single color or for some colors of the four colors.

[Developing Device]

A detailed structure of the developing device 4 will be described using FIGS. 3 and 4. The developing device 4 includes a developing container 41 for accommodating non-magnetic toner and a magnetic carrier and includes a developing sleeve 44 as a developer carrying member rotating while carrying the developer accommodated in the developing container 41. In the developing container 41, feeding screws 43*a* and 43*b* as developer feeding members for circulating the developer in the developing container 41 while stirring and feeding the developer in the developing container 41 are provided. The developing sleeve 44 is capable of feeding the developer to an opposing region opposing the photosensitive drum 1. Inside the developing sleeve 44, a magnet 44*a* as a maximum flux generating means including a plurality of magnetic poles with respect to a circumferential direction is non-rotatably provided. Further, a developing blade 42 as a regulating member forms a thin layer of the developer on a surface of the developing sleeve 44. In FIG. 4 and the like, a longitudinal direction, i.e., a rotational axis direction (axial direction) of the developing sleeve 44 is represented as a widthwise direction W.

Figure 3:
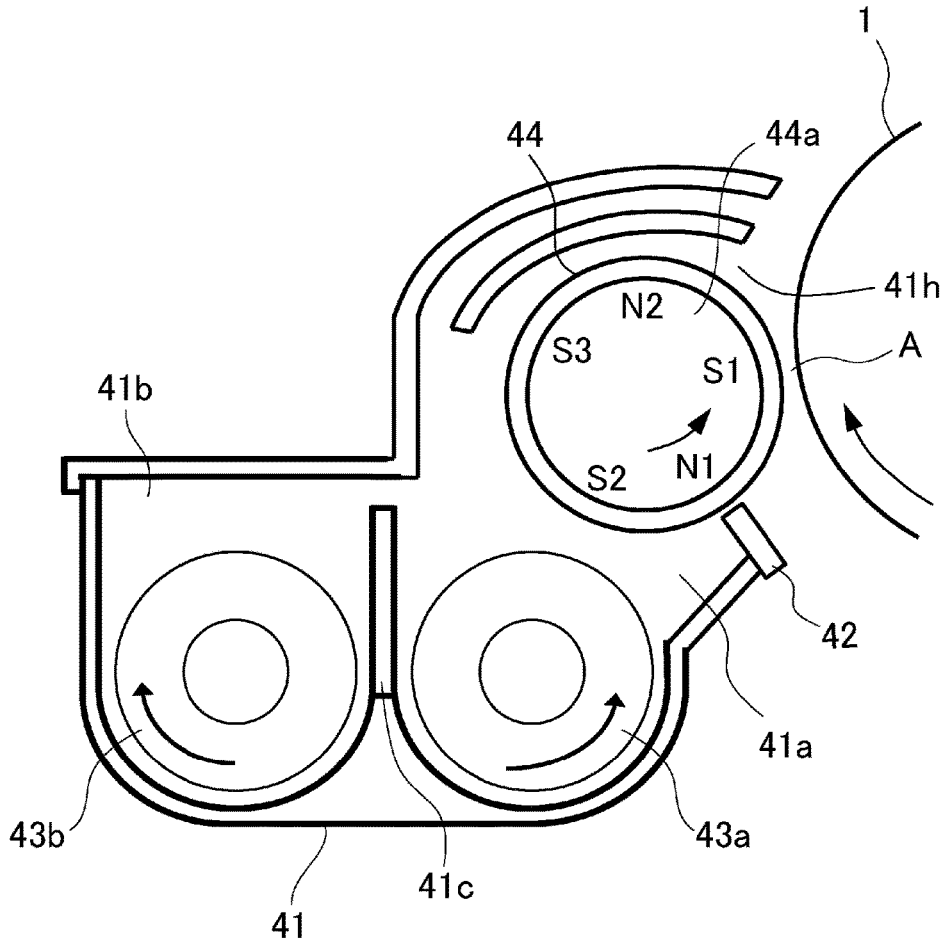
FIG. 3 is a schematic cross-sectional view of a developing device in the First Embodiment.
Figure 4:
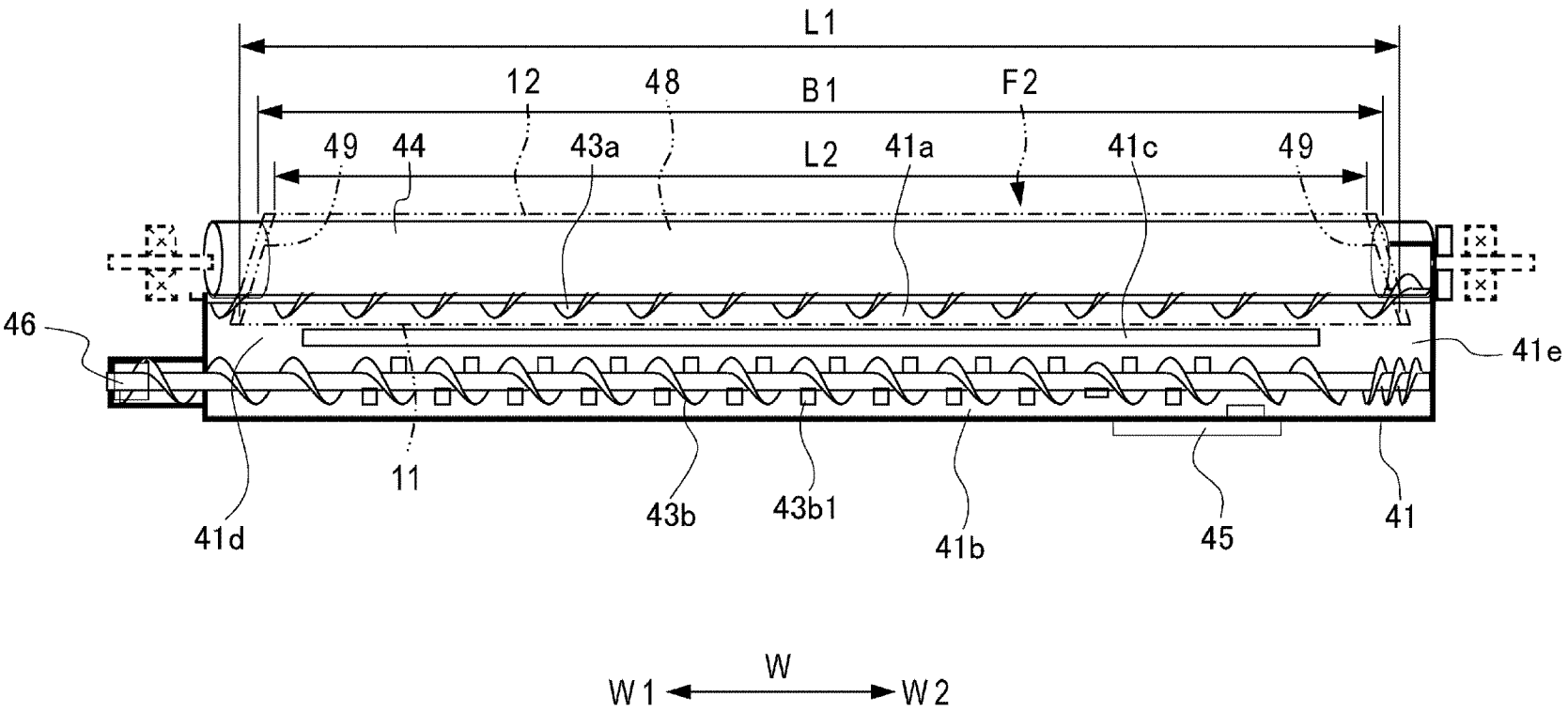
FIG. 4 is a schematic longitudinal sectional view of the developing device in the First Embodiment.

Inside the developing container 41, a substantially central portion thereof is partitioned into left and right portions with respect to a horizontal direction, i.e., into a stirring chamber 41*b* and a developing chamber 41*a* by a partition wall 41*c* extending in a direction perpendicular to the surface of the drawing sheet of FIG. 3, and the developer is accommodated in the developing chamber 41*a* and the stirring chamber 41*b*. In the developing chamber 41*a* and the stirring chamber 41*b*, the feeding screws 43*a* and 43*b* are disposed, respectively. At end portions of the partition wall 41*c* with respect to a longitudinal direction (i.e., at end portions of the developing sleeve 44 with respect to a rotational axis direction, end portions with respect to the widthwise direction W in FIG. 4), delivering portions 41*d* and 41*e* for permitting passing of the developer between the developing chamber 41*a* and the stirring chamber 41*b* are provided.

Each of the feeding screws 43*a* and 43*b* is formed by providing a helical blade as a feeding portion around a shaft (rotation shaft) of a magnetic material. Further, the feeding screw 43*b* is provided, in addition to the helical blade, with stirring ribs 43*b*1 each having a predetermined width with respect to a developer feeding direction so as to project from the shaft in a radial direction of the shaft. The stirring ribs 43*b*1 stir the developer with rotation of the shaft.

The feeding screw 43*a* is disposed at a bottom portion of the developing chamber 41*a* along the rotational axis direction of the developing sleeve 44, and feeds the developer to the developing sleeve 44 while feeding the developer in the developing chamber 41*a* along an axial direction by rotating the rotation shaft by an unshown motor. The developer which is carried on the developing sleeve 44 and of which toner is consumed in a developing step is collected in the developing chamber 41*a*.

The feeding screw 43*b* is disposed at a bottom portion of the stirring chamber 41*b* along the rotational axis direction of the developing sleeve 44, and feeds the developer in the stirring chamber 41*b* along an axial direction in a direction opposite to the developer feeding direction of the feeding screw 43*a*. The developer is fed by the feeding screws 43*a* and 43*b* in this manner, and is circulated in the developing container 41 through the delivering portions 41*d* and 41*e*.

At an upstream end portion of the stirring chamber 41*b* with respect to the developer feeding direction of the feeding screw 43*b*, a developer supply opening 46 permits supply of the developer containing the toner into the developing container 41. The developer supply opening 46 is connected with a supplying and feeding portion 83 of a developer supplying device 80 shown in FIG. 5 and described later. Accordingly, a developer for supply is supplied from the developer supplying device 80 into the stirring chamber 41*b* through the supplying and feeding portion 83 and the developer supply opening 46. The feeding screw 43*b* feeds the developer supplied through the developer supply 46 and the developer which has already been in the stirring chamber 41*b* while stirring these developers, so that a toner content (concentration) is uniformized.

Accordingly, by feeding forces of the feeding screws 43*a* and 43*b*, the developer in the developing chamber 41*a* in which the toner is consumed in the developing step and thus the toner content is lowered is moved into the stirring chamber 41*b* through one delivering portion 41*d* (left (W1) side of FIG. 4). Then, the developer moved in the stirring chamber 41*b* is fed while being stirred with the supplied developer and is moved into the developing chamber 41*a* though the other delivering portion 41*e* (right (W2) side of FIG. 4).

As shown in FIG. 3, the developing chamber 41*a* of the developing container 41 is provided with an opening 41*h* at a position corresponding to an opposing region (developing region) A opposing the photosensitive drum 1, and in this opening 41*h*, the developing sleeve 44 is rotatably provided so as to be partially exposed in a direction of the photosensitive drum 1. On the other hand, the magnet 44*a* incorporated in the developing sleeve 44 is non-rotationally fixed. Such a developing sleeve 44 is rotated by an unshown motor, and is capable of feeding the developer to the opposing region A, and feeds the developer to the photosensitive drum 1 in the opposing region A. In this embodiment, the developing sleeve 44 is formed, in a cylindrical shape, of a non-maximum material such as aluminum or stainless steel. The developing sleeve 44 rotates from below toward above with respect to a direction of gravitation in the opposing region A, i.e., rotates in a counterclockwise direction of FIG. 3.

In a side upstream of the opening 41*h* with respect to the rotation direction of the developing sleeve 44, the developing blade 42 as a regulating member for regulating an amount of the developer carried on the developing sleeve 44 is fixed to the developing container 41. In this embodiment, the developing sleeve 44 rotates in the opposing region A from below toward above with respect to the direction of gravitation, and therefore, the developing blade 42 is positioned below the opposing region A with respect to the direction of gravitation.

The magnet 44*a* includes 5 magnetic poles in total consisting of a plurality of magnetic poles S1, S2, S3, N1 and N2 with respect to a circumferential direction and is formed in a roller shape. The developer in the developing chamber 41*a* is supplied to the developing sleeve 44 by the feeding screw 43*a*, and the developer supplied to the developing sleeve 44 is carried in a predetermined amount on the developing sleeve 44 by a magnetic field generated by an attracting magnetic pole S2 of the magnet 44*a*, and forms a developer accumulating portion.

The developer on the developing sleeve 44 passes through the developer accumulating portion by rotation of the developing sleeve 44 and is erected by a regulating magnetic pole N1, and a layer thickness thereof is regulated by the developing blade 42 opposing the regulating magnetic pole N1. Then, the developer subjected to the layer thickness regulation is fed to the opposing region A opposing the photosensitive drum 1 and is erected by a developing magnetic pole Sl, and forms a magnetic chain. This magnetic chain contacts the photosensitive drum 1 rotating in the same direction as the rotational direction of the developing sleeve 44 in the opposing region A, so that the electrostatic latent image is developed into the toner image with the charged toner.

Thereafter, the developer on the developing sleeve 44 is fed into the developing container 41 by the rotation of the developing sleeve 44 while attraction of the developer to the surface of the developing sleeve 44 is maintained by a feeding magnetic pole N2. Then, the developer carried on the developing sleeve 44 is peeled off the surface of the developing sleeve 44 by a peeling magnetic pole S3 and is collected in the developing chamber 41*a* of the developing container 41.

In the developing container 41, as shown in FIG. 4, an inductance sensor 45 as a toner content sensor for detecting a toner content in the developing container 41 is provided. In this embodiment, the inductance sensor 45 is provided downstream of the stirring chamber 41*b* with respect to the developer feeding direction.

[Developing Supplying Device]

Figure 5:
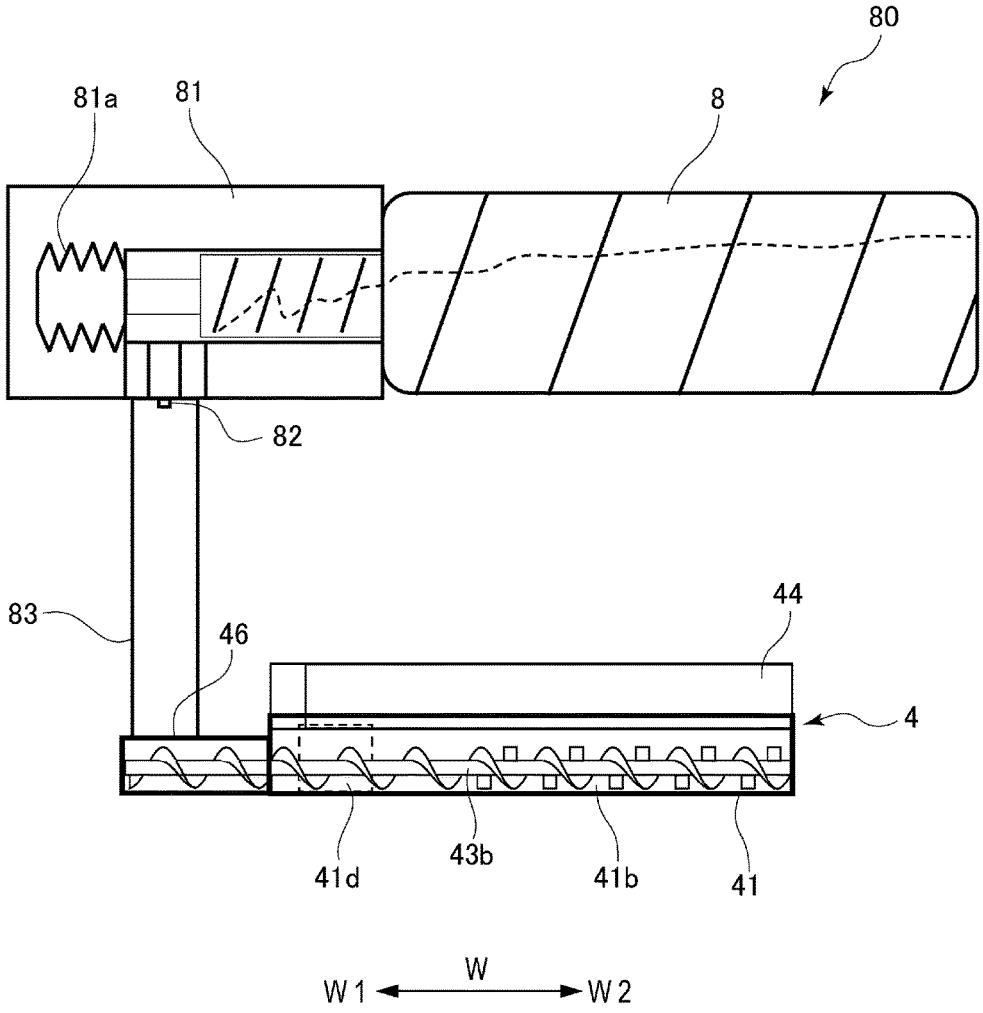
FIG. 5 is a schematic sectional view of a supplying device and the developing device in the First Embodiment.

The developer supplying device 80 will be described using FIG. 5. The developer supplying device 80 includes an accommodating container 8 for accommodating the developer for supply and includes a supplying mechanism 81 and a supplying and feeding portion 83. The accommodating container 8 has a constitution such that a helical groove is provided on an inner wall of a cylindrical container, so that a feeding force feeds the developer in a longitudinal direction (rotational axis direction) by rotation of the accommodating container 8 itself. The accommodating container 8 is connected with the supplying mechanism 81 at a downstream end portion thereof with respect to the developer feeding direction. The supplying mechanism 81 includes a pump portion 81*a* for discharging the developer, fed from the accommodating container 8, through a discharge opening 82. The pump portion 81*a* is formed in a bellow shape and changes in volume by being rotationally driven, so that air pressure generates and thus the developer fed from the accommodating container 8 is discharged through the discharge opening 82.

To the discharge opening 82, an upstream end portion of the supplying and feeding portion 83 is connected, and a lower end portion of the supplying and feeding portion 83 is connected to a developer supply opening 46 of the developing device 4. That is, the developer supplying and feeding portion 83 communicates the discharge opening 82 and the developer supply opening 46 with each other. Accordingly, the developer discharged through the discharge opening 82 by the pump portion 81*a* passes through the developer supplying and feeding portion 83 and is supplied into the developing container 41 of the developing device 4.

In the above-described developing device 4, the developer supply opening 46 is provided upstream of the stirring chamber 41*b* with respect to the developer feeding direction and outside a circulating path, of the developer, formed by the developing chamber 41*a* (FIG. 4) and the stirring chamber 41*b*. Specifically, the developer supply opening 46 is provided upstream of one delivering portion 41*d* with respect to the developer feeding direction of the stirring chamber 41*b*. Accordingly, in the neighborhood of the developer supply opening 46, the developer in the developer circulating path little exists, and the developer for supply only passes.

Such supply by the developer supplying device 80 is carried out by automatic toner replenisher (ATR) control. This ATR control is such that an operation of the developer supplying device 80 is controlled depending on an image ratio during image formation, the toner content detected by the inductance sensor 45, and a density detection result of a patch image by a density sensor 103 (FIG. 1) for detecting a density of the toner, and thus the developer is supplied (replenished) to the developing device 4.

The density sensor 103 is, as shown in FIG. 1, provided downstream of the most downstream image forming portion PY and upstream of the secondary transfer portion T2 with respect to the rotational direction of the intermediary transfer belt 51 so as to oppose the intermediary transfer belt 51. In control using the density sensor 103, for example, at timing such as the time of a start of an image forming job or every image formation of a predetermined print number, a toner image for control (patch image) is transferred onto the intermediary transfer belt 51 and the density of the patch image is detected by the density sensor 103. Then, on the basis of this detection result, supply control of the developer by the developer supplying device 80 is carried out.

Incidentally, the constitution of supplying the developer to the developing device 4 is not limited to such a constitution, but a conventionally known constitution may also be employed.

[Scattering of Developer]

Here, scattering of the developer generating from the developing device 4 will be described. First, as regards the image forming apparatus, not only speed-up and image quality improvement of an output image but also simplification of maintenance are required. As one of methods of the simplification of maintenance, a lowering in degree of contamination of the inside of the image forming apparatus with the developer can be cited. When the inside of the image forming apparatus is contaminated with the developer, an image defect such as contamination of the output image generates, and a cleaning operation is required at the time of exchange of the developing device, the photosensitive drum or the like in some cases. Further, in the case where the developer is deposited on respective driving during systems such as gears, there is a liability that a slip generates in the driving systems.

As one cause of the above-described contamination of the inside of the image forming apparatus with the developer, scattering of the developer from the inside of the developing device can be cited. For example, in the case of a two-component developer, usually, inside the developing device, the toner and the carrier are triboelectrically charged with each other, and therefore, the toner and the carrier are attracted to each other by an electrostatic force. However, there is a liability that due to some impact (shock), scattering of the developer such that this attraction is released (eliminated) and the toner liberated from the carrier is discharged together with air from the inside of the developing device.

A specific example of the scattering of the developer will be described using a developing device 400 in a comparison example shown in FIG. 6. The developing device 400 has the same constitution as that of the above-described developing device 4 except that a constitution of a developing container 401 is different from the constitution of the above-described developing container 41. For this reason, the same constituent elements will be described by adding the same reference numerals or symbols. To the developing device 400, similarly as in the case of the above-described developing device 4, the supplying and feeding portion 83 of the developer supplying device 80 is connected.

The developing container 401 includes an upper cover 402 for covering a portion above the developing sleeve 44. Further, between the upper cover 402 and the developing sleeve 44, a flow path of air flowing into the developing container 401 by rotation of the developing sleeve 44 is formed. This flow path opens at a position opposing the photosensitive drum 1, so that the scattering of the developer from the inside of the developing device principally generates from this flow path. This is because on a side opposite from this flow path (on a lower side of FIG. 6), the developing blade 42 is close to and opposes the developing sleeve 44. That is, at this position, a state in which a layer thickness of the developer carried on the developing sleeve 44 is regulated by the developing blade 42 is formed, so that the air does not readily flow out from a gap between the developing sleeve 44 and the developing blade 42.

Here, the scattering of the developer refers to the developer such as liberated toner or the like generating in the developing container 401 by stirring and feeding of the developer or by supply of the developer passes through an opening of the flow path and is discharged to an outside of the developing container 401 and is not completely collected in the developing container 401.

First, toner liberation will be described. The toner and the carrier which are accommodated in the developing container 401 are triboelectrically charged with each other in the stirring chamber 41*b* and the developing chamber 41*a* and are attracted to each other by an electrostatic attraction (deposition) force generated due to the triboelectric charge and by a non-electrostatic attraction force generated due to a surface property or the like. When an impact or a shearing force is exerted on the toner deposited on the carrier, the toner is peeled off the carrier and thus is liberated from the carrier in the developing container 401. As the impact or the shearing force at this time, behavior of the developer during feeding of the developer by the developing sleeve 44 is cited.

The developer forms, on the developing sleeve 44, a magnetic chain which is a chain-like structure along magnetic lines of force of inside magnetic poles. This magnetic chain raises formed with respect to the rotational direction immediately in front of the magnetic pole and falls formed with respect to the rotational direction when the magnetic chain passes through the magnetic pole. In this case, the rotational direction of the magnetic chain is the same as the rotational direction of the developing sleeve 44. By an impact and a centrifugal force when the magnetic chain falls, the toner is peeled off the carrier. This causes toner liberation.

The magnetic pole largely contributing to the toner liberation when the developer is fed by the developing sleeve 44 is the peeling magnetic pole S3 generating a repulsive magnetic field between itself and the attracting magnetic pole S2. At this peeling magnetic pole S3, in order to peel the developer off the developing sleeve 44, a magnetic force in a direction opposite to the rotational direction of the developing sleeve 44 is applied by the magnetic pole, so that a speed of the fed developer is lowered and thus the developer is stagnated. At this time, a length of the magnetic chain increases, and therefore, there is a tendency that the impact and the centrifugal force when the magnetic chain falls become large and thus a toner liberation amount increases.

Further, also the developer rose into the air before being sufficiently stirred when the developer is supplied from the developer supplying device 80 to the developer supply opening 46 causes the liberated toner in the developing container 401. The toner supplied to the developer supply opening 46 is fed while being stirred with the developer which has already existed in the stirring chamber 41*b*. At this time, in a mixing region of the developer for supply and the already-existing developer, a mixing ratio between the toner and the developer temporarily increases. In the case where the mixing ratio between the toner and the developer is high, a charge amount of the toner lowers, so that an electrostatic depositing force between the toner and the carrier lowers. The toner which is not completely mixed with the developer is liberated as it is or by the impact by the feeding screws 43*a* and 43*b* during stirring and feeding of the developer, so that the liberated toner rises into the air in the developing container 401.

Further, in the case where the developer device 80 from which the developer is discharged by the air pressure generated by the pump 81*a* is used, the air pressure is transmitted through the supplying and feeding portion 83, so that the air flows into the developing container 401 through the developer supply opening 46 in some cases. At this time, an air stream flowing into the developing container 401 raises, into the air in the developing container 401, the liberated toner at a portion where the mixing ratio between the developer and the toner in the neighborhood of the developer supply opening 46 is high. Further, the air pressure transmission to the developing container 401 causes unsteady rise of the atmospheric pressure from the developer supply opening 46 to the stirring chamber 41*b*. This rise of the atmospheric pressure causes the flowing of the liberated toner to the outside of the developing container 401 as described later. Particularly, such inflow of the air by the supply of the developer constitutes one of factors of the scattering of the developer at an end portion, including the developer supply opening 46, with respect to a longitudinal direction of the developing container 401 (the rotational axis direction of the developing sleeve 44).

Next, using FIG. 8, the air stream inside and in the neighborhood of the developing device 400 will be described. The air stream is generated in the neighborhood of the developing device 400 by the developing sleeve 44 and the photosensitive drum 1 in the following manner. First, by the rotation of the developing sleeve 44 and behavior of the magnetic chain on the magnetic pole, the air stream is generated in the substantially same direction as the rotational direction of the developing sleeve 44. This air stream generated in the substantially same direction as the rotational direction of the developing sleeve 44 takes the air into the developing container 401 through a communication opening between the inside and the outside of the developing container 401. Further, the air flows into the developing container 401 also by the supply of the developer.

Assuming that the developing container 401 is a substantially closed space, the air is gas, and therefore, continuity equation is applicable. When a flow rate of the air is v and a density of the air is ρ, there is no source flow of the air in the developing container 401, and therefore, the following formula (1) holds $$\partial\rho/\partial t+\nabla\rho v=0 \quad (1)$$

When a steady state is considered, in respective regions in the developing container 401, the density ρ is roughly constant and therefore, the formula (1) can be represented by the following formula (2).

$$\rho\nabla v=0 \quad (2)$$

From this formula (2), a flow rate pv of the air is conserved. In a longitudinal cross-section in the neighborhood of the developing device 400, income and expenditure of the flow rate ρv is 0, so that the air is discharged to the outside of the developing sleeve 44 in the same amount as the flow rate of the air flowing into the developing container 401 by the developing sleeve 44 and the supply of the developer. Here, the flow rate of the air flowing into the developing container 401 through a communication opening, constituted by the upper cover 402 of the developing container 401 and by the developing sleeve 44, with rotation of the developing sleeve 44 is Qa (sleeve inflow). Further, the air stream discharged through the communication opening between the inside and the outside of the developing container 401 passes through the upper cover 402 side so as to oppose the flow of the air taken through this communication opening. The flow rate of the thus discharged air stream is Qb (sleeve discharge). Further, when the flow rate of the air stream flowing into the developing container 401 with the supply of the developer to the developing device 400 is Qd (supply inflow), a relationship of the following formula (3) holds.

$$Qa+Qd=Qb \quad (3)$$

The air stream taken by the developing sleeve 44 and flowing along the developing sleeve 44 is turned back in the developing container 401 and then is discharged. At this time, at the developer stagnation portion of the peeling magnetic pole S3, when the air stream including the developer peeled off the developing sleeve 44 is turned back, the air stream moves toward a discharge direction while containing, in a large amount, the developer such as the liberated toner generated in the developing container 401.

A step in which the developer contained in the sleeve discharge air (flow rate Qb) is discharged to the outside of the developing container 401 is principally constituted by the following three component steps (factors). A first component step (factor) is such that the sleeve discharge air (flow rate Qb) discharged to the outside of the developing device 400 through the communication opening is directly discharged from a gap between the upper cover 402 and the photosensitive drum 1. A second component step (factor) is such that the sleeve discharge air (flow rate Qb) is mixed, in the neighborhood of the photosensitive drum 1, with the developer carried on the developing sleeve 44 or the developer is transferred, by force of inertia, to an air streaming generated by rotation of the photosensitive drum 1 and is then discharged while being carried on the air stream g. A third component step (factor) is such that the liberated toner contained in the sleeve discharge air (flow rate Qb) is moved to the air stream g, by the force of inertia, generated by rotation of the photosensitive drum 1, and thus is discharged to the outside of the developing container 401.

The scattering of the developer is caused by discharge of the developer to the outside of the developer due to at least one factor of the above-described three factors (component steps). Then, the scattered developer contaminates the periphery of the developing device 400, an outer wall of the developing container 401, the photosensitive drum 1, the exposure device 3 and the transfer device 5.

[Structure of Developing Container in this Embodiment]

Therefore, in this embodiment, the developing container 41 of the developing device 4 is constituted as follows. A detailed structure of the developing container 41 in this embodiment will be described using FIG. 6. A curve C shown at a periphery of FIG. 6 shows a distribution of magnetic flux density of the respective magnetic poles. Further, a rotational direction of the developing sleeve 44 is R. Of the respective magnetic poles of the magnet 44*a*, a peeling magnetic pole S3 corresponds to a first magnetic pole, and an attracting magnetic pole S2 corresponds to a second magnetic pole. The peeling magnetic pole S3 is provided downstream of the opposing region A with respect to the rotational direction R and peels the developer carried on the developing sleeve 44. The attracting magnetic pole S2 is provided adjacently downstream of the peeling magnetic pole S3 with respect to the rotational direction R and has the same polarity as that of the peeling magnetic pole S3, and scoops up the developer in the developing container 41 onto the developing sleeve 44. In FIG. 6, positions of the respective magnetic poles are represented by rectilinear lines showing peak positions of the magnetic flux density of the five magnetic poles.

The developing container 41 in this embodiment includes an upper cover 41*f* for covering the developing sleeve 44 on a side downstream of the opposing region A with respect to the rotational direction R of the developing sleeve 44. The upper cover 41*f* includes an outer cover 47 as a first covering portion and an inner cover 48 as a second covering portion. The outer cover 47 is disposed on a side downstream of the opposing region A with respect to the rotational direction R and covers the developing sleeve 44 with a gap.

The inner cover 48 is disposed between the outer cover 47 and the developing sleeve 44 so as to provide a gap between itself and the outer cover 47 and a gap between itself and the developing sleeve 44 and covers the developing sleeve 44.

A downstream end 48*b* of the inner cover 48 with respect to the rotational direction R is positioned downstream of a position of an upstream minimum M1 of a pair of minimum M1 and M2, with respect to the rotational direction R, in terms of an absolute value of a magnetic flux density distribution of the peeling magnetic pole S3. The rotational direction downstream end 48*b* of the inner cover 48 may preferably be positioned at a peak position of the magnetic flux density of the peeling magnetic pole S3 or positioned downstream of the peak position with respect to the rotational direction R. By disposing the position of the downstream end 48*b* of the inner cover 48 with respect to the rotational direction R at a position satisfying these conditions, a range in which the peeling magnetic pole S3 is covered with the inner cover 48 can be broadened.

However, the rotational direction downstream end 48*b* of the inner cover 48 may preferably be in a position of the horizontal plane H passing through the center O of the developing sleeve 44 or be positioned upstream of the position of the horizontal plane H with respect to the rotational direction R. This is because when the rotational direction downstream end 48*b* of the inner cover 48 is positioned further downstream of this position, the developer peeled off the developing sleeve 44 is not readily taken in the developing chamber 41*a*.

[Characteristic Structure in this Embodiment]

Figure 7:
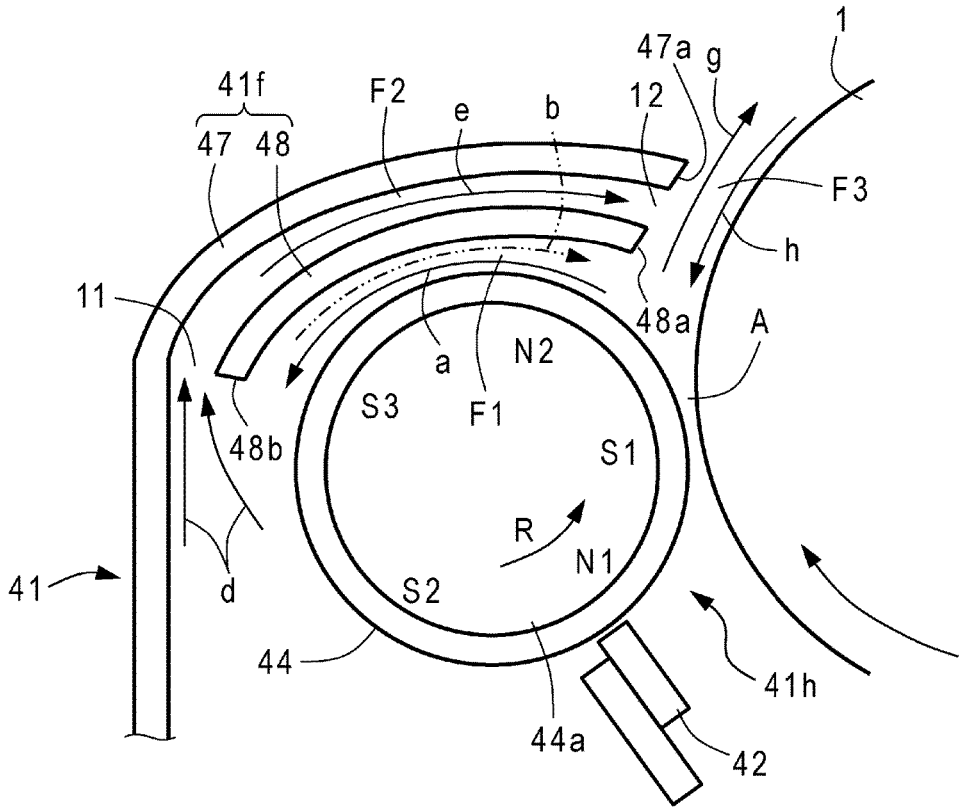
FIG. 7 is a schematic sectional view showing air streams at the periphery of the developing sleeve of the developing device in the First Embodiment.

A characteristic structure of the developing device 4 in this embodiment will be described using FIGS. 4 and 7. First, a gap between the inner cover 48 and the developing sleeve 44 is referred to as first gap (gap) F1. A gap between the inner cover 48 and the outer cover 47 is referred to as a second gap (flow path, gap) F2. A gap between the photosensitive drum 1 and an opposing end portion 47*a*, of the outer cover 47, opposing the photosensitive drum 1 is referred to as a third gap F3. The developing container 41 includes a pair of side walls 49 (FIG. 4) provided at each of both end portions with respect to the widthwise direction W of the developing sleeve 44 between the outer cover 47 and the inner cover 48. Each of the side walls 49 blocks a space between the outer cover 47 and the inner cover 48 and forms the second gap F2 as a flow path along the rotational direction R in cooperation with the outer cover 47 and the inner cover 48.

The second gap F2 includes an inlet port (first opening) 11 through which the air flows in and an outlet port (second opening) 12 through which the air flows out. The inlet port 11 is an opening formed by the inner cover 47, the outer cover 48 and an end portion, of each of the pair of side walls 49, on a downstream side with respect to the rotational direction R. The outlet port 12 is an opening formed by the inner cover 47, the outer cover 48 and an end portion, of each of the pair of side walls 49, on an upstream side with respect to the rotational direction R.

As shown in FIG. 4, the inner cover 48 has widths L1 and L2 satisfying a relationship of L1<L2 at the inlet port 11 and the outlet port 12, respectively, with respect to the axis direction (rotational axis direction), so that the outlet port 12 is narrower in width than the inlet port 11 with respect to the widthwise direction W. Further, the width of the second gap F2 with respect to the widthwise direction W gradually decreases from the inlet port 11 side toward the outlet port 12 side.

The both end portions of the inlet port 11 with respect to the widthwise direction W are positioned outside, with respect to the widthwise direction W, a coated region (developer carrying region) B1 in which the developing sleeve 44 is capable of carrying the developer. The coated region B1 is an image formable region which is subjected to a surface-roughening treatment so that the developer can be carried. The width L1 of the inlet port 11 is broader than the coated region B1. Further, the both end portions of the outlet port 12 with respect to the widthwise direction W are positioned inside the coated region B1 with respect to the widthwise direction W. That is, the width L2 of the outlet port 12 is narrower than the coated region B1.

Figure 6:
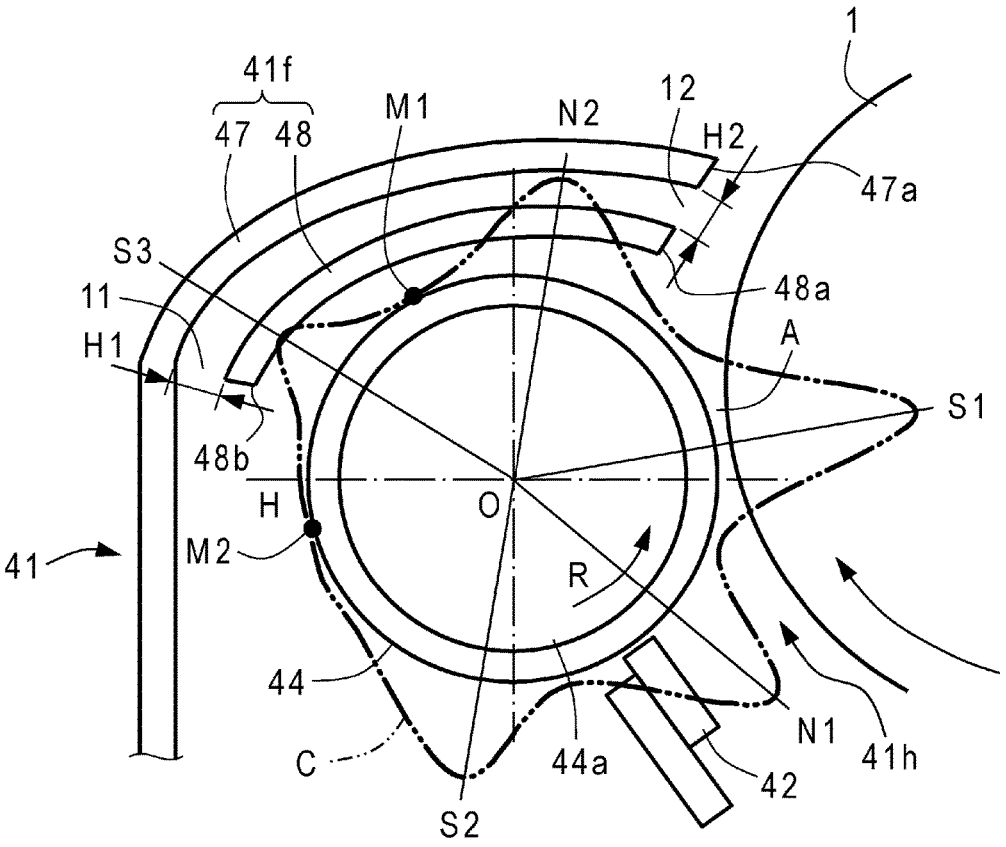
FIG. 6 is a schematic sectional view showing magnetic flux density at a periphery of a developing sleeve of the developing device in the First Embodiment.

Here, a distance (shortest distance) between the outer cover 47 and the inner cover 48 at the inlet port 11 is referred to as a height H1, and a distance (shortest distance) between the outer cover 47 and the inner cover 48 at the outlet port 12 is referred to as a height H2 (FIG. 6). In this case, the respective heights H1 and H2 satisfy a relationship of H1<H2, so that the shortest distance between the outer cover 47 and the inner cover 48 gradually increases from the inlet port 11 toward the outlet port 12. That is, the outlet port 12 is broader than the inlet port 11 with respect to not only a direction perpendicular to the widthwise direction W but also a radial direction of the developing sleeve 44.

Further, the widths L1 and L2 and the heights H1 and H2 satisfy a relationship of L1×H1=L2×H2, so that an area of the inlet port 11 and an area of the outlet port 12 are equal to each other. In this embodiment, in the second gap F2, an area of a cross-section perpendicular to a flowing direction of communicating air (gas) is made constant. In this embodiment, the inlet port 11 is positioned downstream of a position of an upstream minimum M1 of a pair of minimums M1 and M2 with respect to the rotational direction R in terms of an absolute value of a magnetic flux density distribution of the peeling magnetic pole S3. Further, the inlet port 11 is positioned at a peak position of the magnetic flux density of the peeling magnetic pole S3 or downstream of the peak position with respect to the rotational direction R is positioned upstream of the attracting magnetic pole S2 with respect to the rotational direction R.

Air streams generated by the rotation of the developing sleeve 44 and the photosensitive drum 1 will be described. In the neighborhood of the developing sleeve 44, an air stream a generates with the rotation of the developing sleeve 44, and flows into the developing container 41 through the first gap F1. By this flow of the air into the developing container 41, an internal pressure of the developing container 41 increases, so that the air is discharged from a discharging path. Here, in a constitution in which the inner cover 48 is not provided, scattering (scattered) toner generating in the developing container 41 is directly discharged to the outside air by an air stream b through the first gap F1. As described above, in the neighborhood of the peeling magnetic pole S3, a toner liberation amount increases, and therefore, liberated toner is scattered to an outside of the developing container 41 by the air stream b.

On the other hand, in this embodiment, by providing the second gap F2 as the discharging path between the outer cover 47 and the inner cover 48, an air stream d generates from an inside of the developing container 41 toward the second gap F2, and an air stream e generates as a discharging air stream in the second gap F2. As a result, the air stream e as the discharging air stream does not generate in the first gap F1, and therefore, the air in the developing container 41 can be discharged without being passed through the neighborhood of the peeling magnetic pole S3, so that a degree of toner scattering can be reduced. Incidentally, in some cases, the toner in a small amount passes through a path of the air stream e and is discharged to the outside of the developing container 41 through the outlet port 12, but most of the toner is deposited on the opposing photosensitive drum 1 and is collected by the cleaning device 7, and therefore, does not contaminate a periphery of the developing device 4.

Here, there is a liability that the toner discharged from the both end portions, with respect to the rotational direction R, at the opening 41*h* of the developing device 4 is scattered to the outside of the end portions with respect to the widthwise direction W of the photosensitive drum 1 by the air stream with respect to the widthwise direction W of the developing sleeve 44 can causes contamination of the periphery of the developing device 4. Further, as described above, by the flow of the air from the supplying and feeding portion 83 of the developer supplying device 80, compared with the central portion, the air stream entering the inlet port 11 at the both end portions of the developing container 41 contains the toner in a large amount.

On the other hand, the widths L1 and L2 of the inlet port 11 and the outlet port 12, respectively, are L1>L2 and thus the width gradually decreases from the inlet port 11 toward the outlet port 12. For this reason, the toner flows from the both end portions of the developing container 41 through the inlet port 11 into the second gap F2 and passes through the second gap F2 by the air stream e, and is sent to the central portion toward the outlet port 12. Then, the toner is not discharged through the both end portions of the developing container 41, so that the contamination of the periphery of the developing device 4 with the scattering toner can be suppressed.

In order to discharge the air stream with no pressure loss in the air stream e, a cross-sectional area of the second gap F is always made the same (L1×H1=L2×H2). Further, in the case where the width L1 of the inlet port 11 is smaller than the coated region B1 of the developing sleeve 44 and the both end portions of the inner cover 48 with respect to the widthwise direction W do not oppose ends of the coated region B1, the air stream b generates in the coated region B1. As a result, the generation of the air stream b causes the toner scattering from the end portions of the developing container 41, and therefore, the width L1 of the inlet port 11 may preferably be made broader than the coated region B1.

As described above, according to the developing device 4 in this embodiment, the outlet port 12 of the second gap F2 is made narrower than the inlet port 11 with respect to the widthwise direction W. For this reason, the air discharged from the inside of the developing container 41 through the outlet port 12 is discharged toward a portion excluding the end portions of the developing sleeve 44. As a result, discharge of the air, discharged from the inside of the developing container 41, toward the end portions of the developing sleeve 44 can be avoided, so that developer scattering from the end portions of the developing container 41 with respect to the widthwise direction W of the developing sleeve 44 can be sufficiently suppressed. Further, even if the developer is scattered, a scattering amount is small, and therefore, even when the developer is deposited on the image, a deposition amount is to the extent such that the deposited toner cannot be visually recognized, so that a lowering in image quality can be suppressed. In this embodiment, a constitution in which an air path was formed in a space sandwiched between the outer cover 47 and the inner cover 48 was employed. A constitution in which at that time, walls are provided on both sides, with respect to the longitudinal direction of the developing sleeve 44, of the space sandwiched between the outer cover 47 and the inner cover 48 and thus a closed space defined by the walls, the outer cover 47 and the inner cover 48 is formed may also be employed. Or, a constitution in which the walls are not provided on the both sides and a space sandwiched by the outer cover 47 and the inner cover 48 is formed may also be employed.

Further, according to the developing device 4 in this embodiment, the area of the inlet port 11 and the area of the outlet port 12 are equal to each other, and in the second gap F2, the area of the cross-section perpendicular to the flowing direction of the communicating air is constant. For this reason, the pressure loss of the air circulating in the second gap F2 can be made very small, so that there is no generation of the air stream b discharged through the first gap F1 and thus the contamination of the periphery of the developing device 4 with the scattering toner can be suppressed.

Further, according to the developing device 4 in this embodiment, the end portions of the inlet port 11 with respect to the widthwise direction W are positioned outside the coated region B1 with respect to the widthwise direction W. For this reason, compared with the case where the end portions of the inlet port 11 with respect to the widthwise direction W are positioned inside the coated region B1 with respect to the widthwise direction W, the generation of the air stream b in the coated region B1 can be suppressed, so that the contamination of the periphery of the developing device 4 with the scattering toner can be suppressed.

Further, according to the developing device 4 in this embodiment, the end portions of the outlet port 12 with respect to the widthwise direction W are positioned inside the coated region B1 with respect to the widthwise direction W. For this reason, compared with the case where the end portions of the outlet port 12 with respect to the widthwise direction W are positioned outside the coated region B1 with respect to the widthwise direction W, the scattering of the toner to the outside of the end portions of the photosensitive drum 1 with respect to the widthwise direction W by the air stream in the widthwise direction W of the developing device 4 can be suppressed.

Further, as described above, the toner is liberated in a large amount when the magnetic chain falls down at the peeling magnetic pole S3, and therefore, the thus generating liberated toner is contained in a large amount in the air stream e in the first gap F1. According to the developing device 4 in this embodiment, the downstream end 48*b* of the inner cover 48 is positioned downstream of the position of the upstream minimum M1 of the magnetic flux density distribution of the peeling magnetic pole S3 with respect to the rotational direction R, so that at least a part of the peeling magnetic pole S3 can be covered with the inner cover 48. Particularly, in this embodiment, the downstream end 48*b* of the inner cover 48 is positioned downstream of the peak position of the peeling magnetic pole S3 with respect to the rotational direction R, and therefore, when the magnetic chain falls down at the peeling magnetic pole S3, most of a region where the liberated toner generates can be covered with the inner cover 48.

[Comparison Experiment]

In order to confirm an effect of this embodiment, an experiment in which the toner scattering amount was compared between a constitution of a comparison example and the constitution of this embodiment will be described. When a toner supplying operation for supplying the toner to each of developing devices was performed, measurement of an amount of the toner scattering from the neighborhood of an opening of a developing container and check of contamination of a periphery of each of the developing devices with the toner were carried out. First, an outline of a toner scattering amount measuring method employed in this experiment will be described with reference to FIG. 7. Incidentally, an apparatus used in the experiment is prepared by assembling the photosensitive drum, the developing device and other constituent members, excluding the exposure device, disposed at the periphery of the photosensitive drum into a unit. In the experiment, similarly as during normal image formation, in a state in which the rotation of the photosensitive drum, the drive of the charging device and the developing device and the bias application are carried out, the toner scattering amount was measured in the following manner.

In a region excluding both longitudinal end of the developing device 4 with respect to the widthwise direction W, the toner in the developing device 4 is passed by the air stream g, through the third gap F3 between the photosensitive drum 1 and the opposing end portion 47*a*, of the outer cover 47, opposing the photosensitive drum 1 and is scattered to the outside of the developing device 4. Therefore, the central portion and the end portions of the third gap F3 with respect to the widthwise direction W is selectively irradiated with line laser beam (light) so as to be perpendicular to the developing sleeve 44 and the photosensitive drum 1. The line laser beam is a laser beam (light) which is emitted in a line shape with a certain line width and which forms a sector-shaped two-dimensional plane optical path. The line laser beam is usually prepared by scattering a dot laser beam in a certain direction by a cylindrical lens or a rod lens. The scattering toner flying on the optical path of the line laser beam scatters the laser light (beam). For that reason, from a direction substantially perpendicular to an irradiation direction of the line laser beam, a laser irradiation range is observed through a high-speed camera or the like, whereby it is possible to measure the number of particles and a locus of the scattering toner present in the laser irradiation range.

As regards the line laser beam, a YAG laser ("DPGL-5W", manufactured by Japan Laser Corp.) was used as a light source. Further, an optical system using a cylindrical lens (attached to the product) was adjusted so that a line width was 0.5 mm in the third gap F3 and then an object was irradiated with the line laser beam. For observation, a high-speed camera ("SA-3", manufactured by PHOTORON Ltd.) was used. Further, in order to permit observation of the scattering toner on the line laser beam, a shooting condition (frame rate and exposure time) and the optical system (such as the lens) of the high-speed camera were selected.

The number of scattering (scattered) toner particles, obtained by the above-described method, passing through each of the central portion and the end portion of the third gap F3 with respect to the widthwise direction W was converted into a scattering toner (particle) number corresponding to that per A4-sized sheet (210 mm×297 mm).

Embodiment 1

The above-described developing device 4 in First Embodiment was used, and a constitution satisfying L1>L2 was employed. In this embodiment, L1=320 mm, L2=290 mm, H1=2.9 mm and H2=3.2 mm were set.

Comparison Example 1

Figure 8:
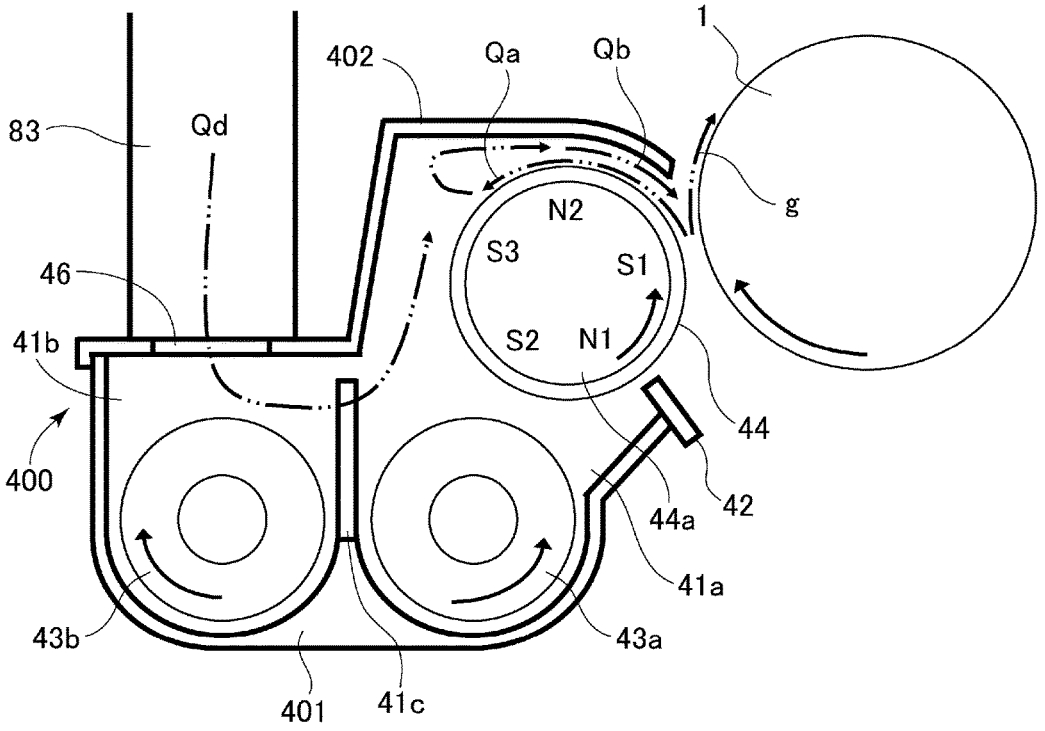
FIG. 8 is a sectional view schematically showing an air flow of a developing device in a comparison example.

A conventional developing device 400 shown in FIG. 8 was used. As shown in FIG. 8, the developing device 400 does not include the inner cover.

Comparison Example 2

In the above-described developing device 4 in the First Embodiment, a constitution satisfying L1=L2 was employed. In this comparison example, L1=320 mm, L2=320 mm, H1=2.9 mm and H2=2.9 mm were set.

Figure 12:
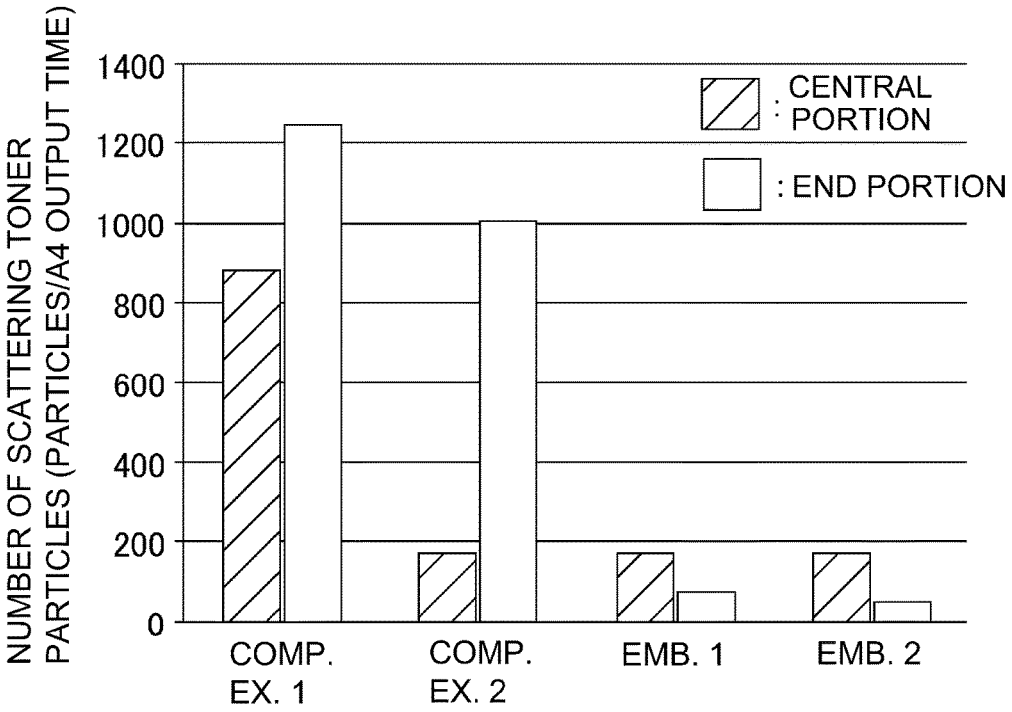
FIG. 12 is a graph showing a result of a comparative experiment.

In the above-described conditions, experiments were conducted, and results thereof were compared with each other. Other constitutions are common to Embodiment 1 and Comparison Examples 1 and 2. The results of the experiments are shown in FIG. 12. In Comparison Example 2, compared with Comparison Example 1, the scattering (scattered) toner particle number corresponding to an output time of a single A4-sized sheet in a range of 0.5 mm width decreases, but a scattering suppressing effect at the end portion is small compared with that at the central portion. In Embodiment 1, compared with Comparison Example 2, the scattering toner particle number at the end portion is decreased, so that scattering suppressing power was largely improved. Accordingly, it was confirmed that compared with Comparison Examples 1 and 2, the constitution of Embodiment 1 was effective in reducing the degree of the toner scattering.

Second Embodiment

Next, Second Embodiment of the present invention will be described while making reference to FIG. 9. In this embodiment, the constitution is different from the constitution of the First Embodiment in that the second gap F2 includes a same width portion F2*a* and a gradually narrowing (decreasing) portion F2*b*. However, other constitutions are similar to those in the First Embodiment, and therefore, are represented by the same reference numerals or symbols and will be omitted from detailed description.

Figure 9:
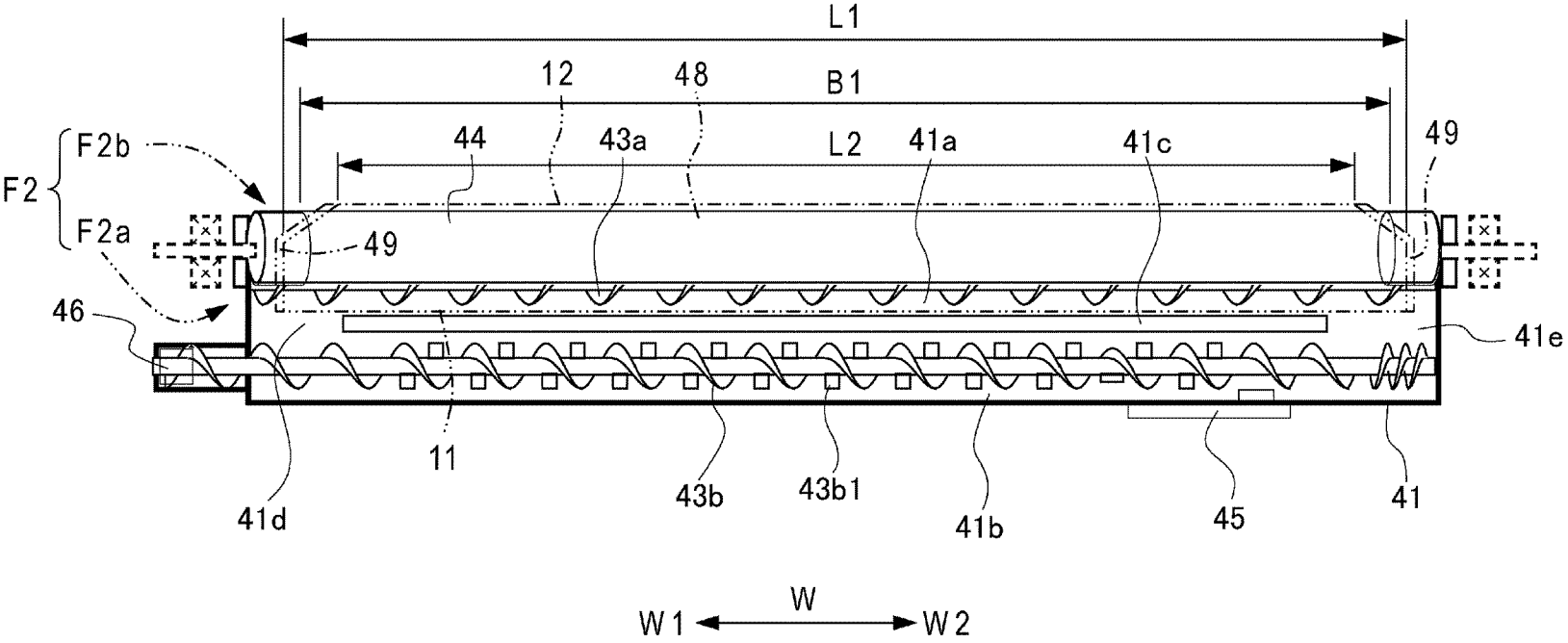
FIG. 9 is a schematic longitudinal sectional view of a developing device in a Second Embodiment.

As shown in FIG. 9, the same width portion F2*a* is formed so that a width thereof with respect to the widthwise direction W is a certain width from the inlet port 11 toward an upstream side with respect to the rotational direction by a predetermined length. The gradually narrowing portion F2*b* is formed so that a width thereof with respect to the widthwise direction W gradually decreases in width with respect to the widthwise direction W from the same width portion F2*a* toward the outlet port 12. As a result, the width of the inner cover 48 with respect to the widthwise direction W of the developing sleeve 44 maintains the width L2 from the inlet port 11 toward the outlet port 12 until an intermediary portion and gradually decreases from the intermediary portion to the outlet port 12. Further, also in this embodiment, the distance between the inner cover 47 and the outer cover 48 is different depending on a position so that the cross-sectional area of the second gap F2 is always the same, so that the width L1 of the inlet port 11 is broader than the coated region B1. Further, also in this embodiment, the inner cover 48 covers the neighborhood of the peeling magnetic pole S3 in an entire region of the coated region B1 and thus does not generate the discharging air stream b (FIG. 7) in the first gap F1.

Also according to the developing device 4 in this embodiment, the outlet port 12 of the second gap F2 is made narrower than the inlet port 11 with respect to the widthwise direction W. For this reason, the air discharged from the inside of the developing container 41 through the outlet port 12 is discharged toward a portion excluding the end portions of the developing sleeve 44. As a result, discharge of the air, discharged from the inside of the developing container 41, toward the end portions of the developing sleeve 44 can be avoided, so that developer scattering from the end portions of the developing container 41 with respect to the widthwise direction W of the developing sleeve 44 can be sufficiently suppressed. Further, even if the developer is scattered, a scattering amount is small, and therefore, even when the developer is deposited on the image, a deposition amount is to the extent such that the deposited toner cannot be visually recognized, so that a lowering in image quality can be suppressed.

Further, according to the developing device 4 in this embodiment, the same width portion F2*a* having a certain width with respect to the widthwise direction W from the inlet port 11 toward the upstream side by a predetermined length is provided. For this reason, compared with the case where the same width portion F2*a* is not provided and the width of the inner cover 48 gradually decreases from the inlet port 11 toward the outlet port 12, an area in which the end portions of the coated region B1 of the developing sleeve 44 with respect to the widthwise direction is covered with the inner cover 48 increases. As a result, the generation of the air stream b in the coated region B1 can be more effectively suppressed, so that the contamination of the periphery of the developing device 4 with the scattering toner can be suppressed.

Embodiment 2

The above-described developing device 4 in the Second Embodiment was used, and a constitution satisfying L1>L2 was employed. An experiment similar to that of Embodiment 1 was conducted. In this embodiment, L1=320 mm, L2=290 mm, H1=2.9 mm and H2=3.2 mm were set.

A result of the experiment is shown in FIG. 12. In Embodiment 2, compared with Embodiment 1, a scattering suppressing effect was further improved. This would be considered because in Embodiment 2, the same width portion F2*a* is provided and therefore the area in which the end portions of the coated region B1 of the developing sleeve 44 with respect to the widthwise direction W increases and thus the generation of the air stream b in the coated region B1 is more effectively suppressed. Accordingly, it was confirmed that the constitution of Embodiment 2 was effective in reducing the degree of the toner scattering similarly as in Embodiment 1.

Third Embodiment

Next, Third Embodiment of the present invention will be described while making reference to FIGS. 10 and 11. In this embodiment, the constitution is different from the constitution of the First Embodiment in that the outlet port 12 does not oppose the photosensitive drum 1 but opposes a neighborhood of an uppermost portion (top) of the developing sleeve 44. However, other constitutions are similar to those in the First Embodiment, and therefore, are represented by the same reference numerals or symbols and will be omitted from detailed description.

Figure 10:
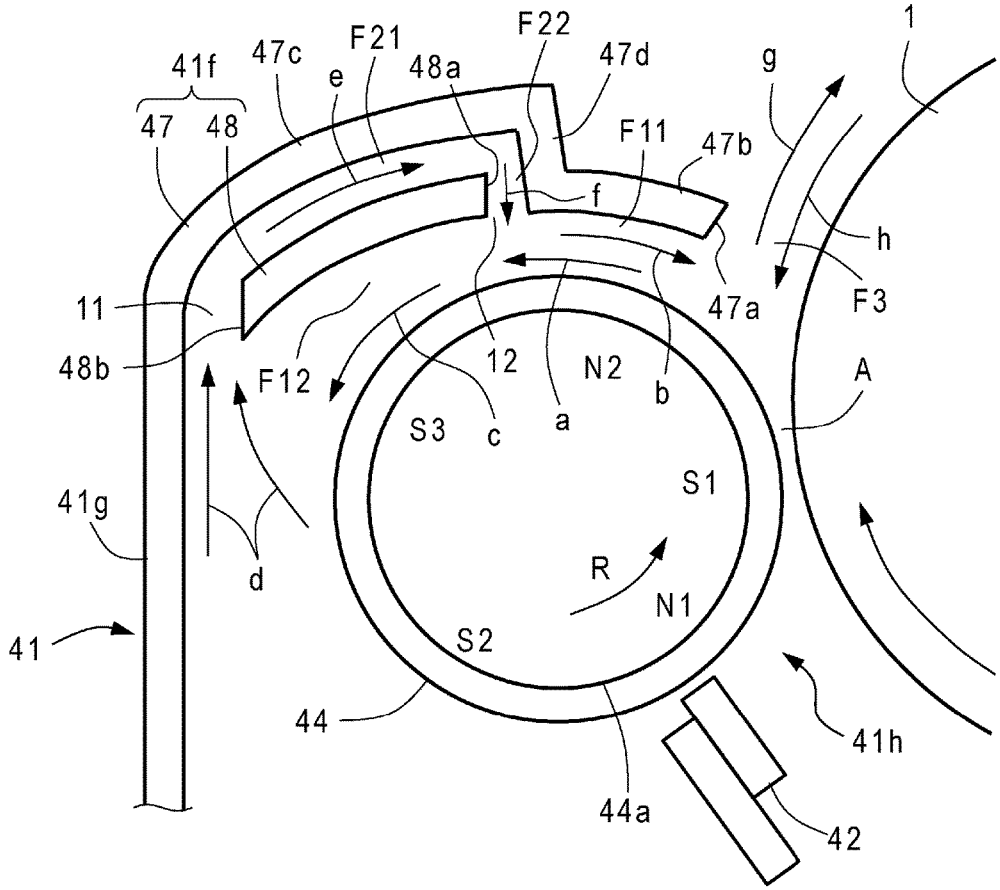
FIG. 10 is a sectional view showing air streams at a periphery of a developing sleeve of a developing device in the Third Embodiment.
Figure 11:
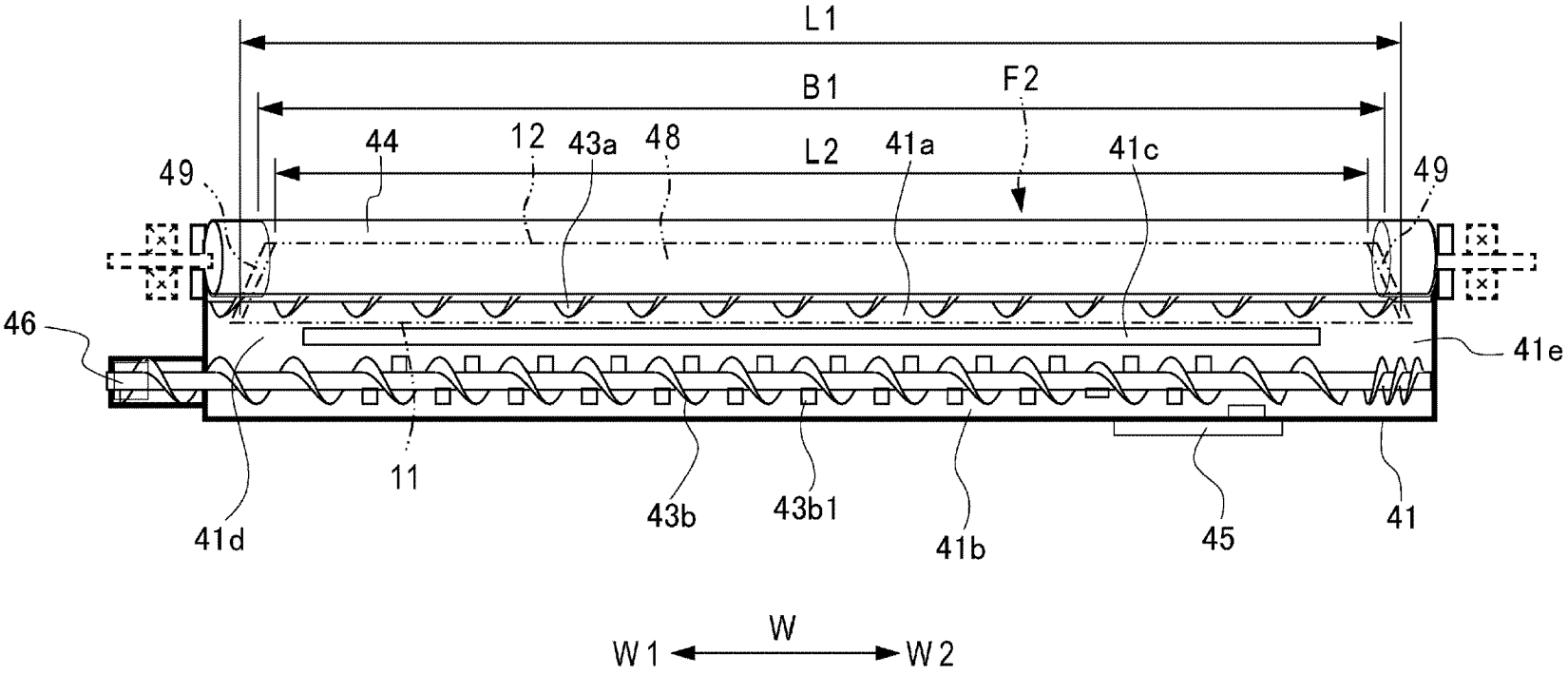
FIG. 11 is a schematic longitudinal sectional view of the developing device in the Third Embodiment.

As shown in FIGS. 10 and 11, the outer cover 47 is formed by being bent toward the photosensitive drum 1 so as to cover the developing sleeve 44 from an upper end of a side wall 41*g* of the developing container 41 on a side opposite from the photosensitive drum 1 with respect to the developing sleeve 44.

The outer cover 47 includes a first opposing portion 47*b* provided in the photosensitive drum 1 side, a second opposing portion 47*c* provided on the side wall 41*g* side, and a continuous portion 47*d* connecting the first opposing portion 47*b* and the second opposing portion 47*c*.

The first opposing portion 47*b* opposes the developing sleeve 44 in a side upstream, with respect to the rotational direction R of the developing sleeve 44, of a part (the continuous portion 47*d*) opposing the rotational direction upstream end 48*a* of the inner cover 48. The second opposing portion 47*c* opposes an intermediary portion between the upstream end 48*a* and the downstream end 48*b* of the inner cover 48 with respect to the rotational direction R.

The second opposing portion 47*c* is disposed outside the first opposing portion 47*b* with respect to a radial direction of the developing sleeve 44 since the inner cover 48 is disposed between itself and the developing sleeve 44. For this reason, the continuous portion 47*d* connecting the upstream end of the second opposing portion 47*c* with respect to the rotational direction R and the downstream end of the first opposing portion 47*b* with respect to the rotational direction R is provided. The continuous portion 47*d* is formed so as to be bent toward the developing sleeve 44 side from the upstream end of the second opposing portion 47*c* with respect to the rotational direction R. Further, the continuous portion 47*d* opposes the upstream end 48*a* of the inner cover 48 with respect to the rotational direction R with the second gap F22 with respect to the rotational direction R. That is, the inner cover 48 is formed so that the upstream end 48*a* thereof with respect to the rotational direction R opposes a part of the outer cover 47 through the second gap 22 with respect to the rotational direction R.

In the neighborhood of the developing sleeve 44, with the rotation of the developing sleeve 44, the air streams a and c generate in the first gaps F11 and F12, respectively, and flow into the developing container 41. By the flow of the air rate the developing container 41, the internal pressure of the developing container 41 increases, so that the air is discharged through a discharging path. In this embodiment, similarly as in the First Embodiment, the air stream d generates from the inside of the developing container 41 toward the second gaps (flow paths) F21 and F22 between the outer cover 47 and the inner cover 48, so that the air streams e and f generate as discharging air streams in the second gaps F21 and F22, respectively. The air stream f merges with the first gap F11 between the developing sleeve 44 and the outer cover 47 in the neighborhood of the uppermost portion of the developing sleeve 44, and then is discharged to the outside of the developing container 41 through the air streams b and g.

Further, as shown in FIG. 11, the widths L1 and L2 of the inlet port 11 and the outlet port 12, respectively, are such that the width of the inner cover 48 gradually decrease so that L1>L2 is satisfied. For this reason, the air streams e and f from the end portions of the inlet port 11 with respect to the widthwise direction W are moved toward the central portion, so that the degree of the toner scattering from the opening 41*h* of the developing sleeve 44 at the end portions can be reduced.

Also according to the developing device 4 in this embodiment, the outlet port 12 of the second gap F22 is made narrower than the inlet port 11 with respect to the widthwise direction W. For this reason, the air discharged from the inside of the developing container 41 through the outlet port 12 is discharged toward a portion excluding the end portions of the developing sleeve 44. As a result, discharge of the air, discharged from the inside of the developing container 41, toward the end portions of the developing sleeve 44 can be avoided, so that developer scattering from the end portions of the developing container 41 with respect to the widthwise direction W of the developing sleeve 44 can be sufficiently suppressed. Further, even if the developer is scattered, a scattering amount is small, and therefore, even when the developer is deposited on the image, a deposition amount is to the extent such that the deposited toner cannot be visually recognized, so that a lowering in image quality can be suppressed. In this embodiment, a constitution in which the air streams were formed in the space sandwiched between the outer cover 47 and the inner cover 48 was described. A constitution in which at that time, walls are provided on both sides, with respect to the longitudinal direction of the developing sleeve 44, of the space sandwiched between the outer cover 47 and the inner cover 48 and thus a closed space defined by the walls, the outer cover 47 and the inner cover 48 is formed may also be employed. Or, a constitution in which the walls are not provided on the both sides and a space sandwiched by the outer cover 47 and the inner cover 48 is formed may also be employed.

Further, according to the developing device 4 in this embodiment, the upstream end 48*a* of the inner cover 48 with respect to the rotational direction R opposes the continuous portion 47*d* of the outer cover 47 through the second gap F22 with respect to the rotational direction R. For this reason, the air stream e passing through the second gap F21 merges with the air stream b in the first gap F11 through the second gap F22. At this time, the air stream f flowing through the second gap F22 constitutes the air curtain, and thus the air stream containing the liberated toner in a large amount is not readily discharged from the first gap F11, so that the scattering of the developer can be suppressed.

Incidentally, in the above-described embodiments, as the constitution of the developing devices, the constitution using the two-component developer containing the toner and the carrier were described. However, even in the case of using a one-component developer containing toner having a magnetic property, the present invention is applicable even when a constitution including the above-described peeling magnetic pole S3 is employed. Further, the constitutions of the above-described embodiments can be carried out by being appropriately combined with each other. For example, the constitutions of the Second and Third Embodiments may also be combined with each other.

Fourth Embodiment

Next, a Fourth Embodiment of the present invention will be described while making reference to FIGS. 7 and 13. However, other constitutions are similar to those in the First Embodiment, and therefore, are represented by the same reference numerals or symbols and will be omitted from detailed description.

First, a gap between the inner cover 48 and the developing sleeve 44 is referred to as a first gap (gap) F1. A gap between the inner cover 48 and the outer cover 47 is referred to as a second gap (flow path, gap) F2. A gap between the photosensitive drum 1 and an opposing end portion 47*a*, of the outer cover 47, opposing the photosensitive drum 1 is referred to as a third gap F3. The developing container 41 includes a pair of side walls 49 provided at each of both end portions with respect to the widthwise direction W of the developing sleeve 44 between the outer cover 47 and the inner cover 48. Each of the side walls 49 blocks a space between the outer cover 47 and the inner cover 48 and forms the second gap F2 as a flow path along the rotational direction R in cooperation with the outer cover 47 and the inner cover 48.

The second gap F2 includes an inlet port (opening) 11 through which the air flows in and an outlet port 12 through which the air flows out. The inlet port 11 is an opening formed by the inner cover 47, the outer cover 48 and an end portion, of each of the pair of side walls 49, on a downstream side with respect to the rotational direction R. The outlet port 12 is an opening formed by the inner cover 47, the outer cover 48 and an end portion, of each of the pair of side walls 49, on an upstream side with respect to the rotational direction R.

In this embodiment, the inlet port 11 includes a central region B2 and end regions B3. That is, at least a part of the second gap F2 includes the end regions B3 positioned on the both end sides of the developing sleeve 44 and includes the central region B2 positioned in the central side of the developing sleeve 44 with respect to the widthwise direction W. Each of the end regions B3 is formed so as to be narrower than the central region B2 with respect to a direction perpendicular to the flowing direction of the communicating (circulating) air and perpendicular to the widthwise direction W in the second gap F2. That is, in the case where the distance between the outer cover 47 and the inner cover 48 is a height H, a height H2 (shortest distance) in the central region B2 and a height H3 (shortest distance) in the end regions B3 satisfy a relationship of H2>H3.

Further, a shape of the inlet port 11 and a shape of the outlet port 12 are the same. Further, in the second gap F2, an area of a cross-section perpendicular to a flowing direction of the communicating air is made constant. In this embodiment, the surface of the inner cover 48 on the second gap F2 side is constituted by a single curved surface which has a rectilinear shape with respect to the widthwise direction W. Further, the surface of the outer cover 47 on the second gap F2 side is constituted by two rectilinear surfaces (bent surface) such that a central portion thereof projects upward and includes a top 47*p* and that each of end portions thereof inclines downward.

As a result, the height H increases toward the central region B2 of the second gap F2, so that the pressure loss of the communicating air decreases. As a result, when the air taken in the developing container 41 by the rotation of the developing sleeve 44 is discharged from the second gap F2, the air in the end regions B3 is concentrated at the central region B2 ((b) of FIG. 13). As a result, the degree of end portion scattering of the toner can be suppressed while discharging the air in the developing container 41 by the air stream taken in the developing container 41. In this embodiment, the inlet port 11 is positioned downstream of a position of an upstream minimum M1 of a pair of minimums M1 and M2 with respect to the rotational direction R in terms of an absolute value of a magnetic flux density distribution of the peeling magnetic pole S3. Further, the inlet port 11 is positioned at a peak position of the magnetic flux density of the peeling magnetic pole S3 or downstream of the peak position with respect to the rotational direction R is positioned upstream of the attracting magnetic pole S2 with respect to the rotational direction R.

Air streams generated by the rotation of the developing sleeve 44 and the photosensitive drum 1 will be described. In the neighborhood of the developing sleeve 44, an air stream a generates with the rotation of the developing sleeve 44, and flows into the developing container 41 through the first gap F1. By this flow of the air into the developing container 41, an internal pressure of the developing container 41 increases, so that the air is discharged from a discharging path. Here, in a constitution in which the inner cover 48 is not provided, scattering (scattered) toner generating in the developing container 41 is directly discharged to the outside air by an air stream b through the first gap F1. As described above, in the neighborhood of the peeling magnetic pole S3, a toner liberation amount increases, and therefore, liberated toner is scattered to an outside of the developing container 41 by the air stream b.

On the other hand, in this embodiment, by providing the second gap F2 as the discharging path between the outer cover 47 and the inner cover 48, an air stream d generates from an inside of the developing container 41 toward the second gap F2, and an air stream e generates as a discharging air stream in the second gap F2. As a result, the air stream e as the discharging air stream does not generate in the first gap F1, and therefore, the air in the developing container 41 can be discharged without being passed through the neighborhood of the peeling magnetic pole S3, so that a degree of toner scattering can be reduced. Incidentally, in some cases, the toner in a small amount passes through a path of the air stream e and is discharged to the outside of the developing container 41 through the outlet port 12, but most of the toner is deposited on the opposing photosensitive drum 1 and is collected by the cleaning device 7, and therefore, does not contaminate a periphery of the developing device 4.

Here, there is a liability that the toner discharged from the both end portions, with respect to the rotational direction R, at the opening 41*h* of the developing device 4 is scattered to the outside of the end portions with respect to the widthwise direction W of the photosensitive drum 1 by the air stream with respect to the widthwise direction W of the developing sleeve 44 can causes contamination of the periphery of the developing device 4. Further, as described above, by the flow of the air from the supplying and feeding portion 83 of the developer supplying device 80, compared with the central portion, the air stream entering the inlet port 11 at the both end portions of the developing container 41 contains the toner in a large amount.

On the other hand, in this embodiment, each of the end regions B3 is formed so as to narrower than the central region B2 with respect to the direction perpendicular to the flowing direction of the communicating air in the second gap F2 and perpendicular to the widthwise direction W. As a result, while discharging the air in the developing container 41 by the air stream taken in the developing container 41, the scattering of the developer from the end portions of the developing sleeve 44 of the developing container 41 with respect to the widthwise direction W can be sufficiently suppressed and thus the contamination of the periphery of the developing device 4 with the scattering toner can be suppressed.

Further, in the case where each of the end regions B3 is closer to the central portion side than ends of the coated region B1 of the developing sleeve 44 are and the both end portions of the inner cover 48 with respect to the widthwise direction W does not oppose the ends of the coated region B1, the air stream b generates in the coated region B1. As a result, the generation of the air stream b causes the toner scattering from the end portions of the developing container 41, and therefore, at least a part of each of the end regions B3 may preferably be positioned outside the coated region B1.

Here, the central region B2 and the end regions B3 will be described using a specific example. Both end portions of the developing sleeve 44 are sealed. As a sealing constitution for sealing the both end portions of the developing sleeve 44, a magnetic sealing constitution for magnetically blocking between the outside and the inside of the developing container 41 is used. FIG. 14 shows an example of the magnetic sealing constitution. The magnetic sealing constitution shown in FIG. 14 is such that a magnetic plate 13 and a magnet sheet 14 are provided at a sleeve end portion 44*b* of the developing sleeve 44 which has not been subjected to the surface roughening process, i.e., outside the coated region B1 (developer carrying region) with respect to the widthwise W direction of the developing sleeve 44.

The magnetic plate 13 is capable of forming the magnetic chain while covering the developing sleeve 44 in a non-contact manner in the form along an outer periphery of the developing sleeve 44. That is, a magnetic force generates between the magnetic plate 13 and the magnet 44*a* of the developing sleeve 44, so that the developer entering between the magnetic plate 13 and the developing sleeve 44 forms the magnetic chain. This magnetic chain blocks (closes) a gap between the magnetic plate 13 and the developing sleeve 44, and prevents leakage of the developer from the sleeve end portion 44*b*. Further, the magnet sheet 14 is provided outside the magnetic plate 13 with respect to the rotational axis direction of the developing sleeve 44. The magnet sheet 14 holds, by the magnetic force, the developer leaked through between the magnetic plate 13 and the developing sleeve 44. Thus, by providing the magnetic plate 13 and the magnet sheet 14, the developer leakage from the sleeve end portion 44*b* is suppressed.

The central region B2 is formed so that each of both ends thereof is in a position spaced from, e.g., a position of the magnetic plate 13 toward a central side by 10 mm or more and 30 mm or less. Thus, the end regions B3 are capable of covering the both end portions of the coated region B1. In this embodiment, as an example, a longitudinal length of the central region B2 was 290 mm-310 mm, and a longitudinal length of each of the end regions B3 was 20 mm-40 mm. As a result, a part of each of the end regions B3 is positioned outside the coated region B1.

As described above, according to the developing device 4 of this embodiment, the end regions B3 in the second gap F2 are narrower than the central region B2 with respect to the direction perpendicular to the air flowing direction and perpendicular to the widthwise direction W. For this reason, the pressure loss of the air flowing through the second gap F2 is larger in the end regions B3 than in the central region B2, so that the air discharged from the inside of the developing container 41 through the second gap F2 flows easier in the central region B2 than in the end regions B3. As a result, when the air taken in the developing container 41 by the rotation of the developing sleeve 44 passes through the second gap F2, the air in the end regions B3 is concentrated at the central region B2. As a result, not only the air from the end portions of the developing sleeve 44 of the developing container 41 with respect to the widthwise direction W can be made hard to flow in the second gap F2, but also discharge of the air, discharged from the inside of the developing container 41, toward the end portions of the developing sleeve 44 can be avoided. Therefore, developer scattering from the end portions of the developing container 41 with respect to the widthwise direction W of the developing sleeve 44 can be sufficiently suppressed. Further, even if the developer is scattered, a scattering amount is small, and therefore, even when the developer is deposited on the image, a deposition amount is to the extent such that the deposited toner cannot be visually recognized, so that a lowering in image quality can be suppressed.

Further, according to the developing device 4 in this embodiment, the area of the inlet port 11 and the area of the outlet port 12 are equal to each other, and in the second gap F2, the area of the cross-section perpendicular to the flowing direction of the communicating air is constant. For this reason, the pressure loss of the air circulating in an entirety of the second gap F2 can be made very small, so that there is no generation of the air stream b discharged through the first gap F1 and thus the contamination of the periphery of the developing device 4 with the scattering toner can be suppressed.

Further, according to the developing device 4 in this embodiment, at least a part of each of the end regions B3 is positioned outside the coated region B1 with respect to the widthwise direction W. For this reason, compared with the case where the entire region of the end regions B3 is positioned inside the coated region B1 with respect to the widthwise direction W, the generation of the air stream b in the coated region B1 can be suppressed, so that the contamination of the periphery of the developing device 4 with the scattering toner can be suppressed.

Further, according to the developing device 4 in this embodiment, the end portions of the outlet port 12 with respect to the widthwise direction W are positioned inside the coated region B1 with respect to the widthwise direction W. For this reason, compared with the case where the end portions of the outlet port 12 with respect to the widthwise direction W are positioned outside the coated region B1 with respect to the widthwise direction W, the scattering of the toner to the outside of the end portions of the photosensitive drum 1 with respect to the widthwise direction W by the air stream in the widthwise direction W of the developing device 4 can be suppressed.

Further, as described above, the toner is liberated in a large amount when the magnetic chain falls down at the peeling magnetic pole S3, and therefore, the thus generating liberated toner is contained in a large amount in the air stream e in the first gap F1. According to the developing device 4 in this embodiment, the downstream end 48*b* of the inner cover 48 is positioned downstream of the position of the upstream minimum M1 of the magnetic flux density distribution of the peeling magnetic pole S3 with respect to the rotational direction R, so that at least a part of the peeling magnetic pole S3 can be covered with the inner cover 48. Particularly, in this embodiment, the downstream end 48*b* of the inner cover 48 is positioned downstream of the peak position of the peeling magnetic pole S3 with respect to the rotational direction R, and therefore, when the magnetic chain falls down at the peeling magnetic pole S3, most of a region where the liberated toner generates can be covered with the inner cover 48. Incidentally, in the above description, the present invention is applied to the developing device having the constitution of FIG. 7, but is also applicable to the developing device having the constitution of FIG. 10.

Other Embodiments

In the above-described Fourth Embodiment, as regards the cross-sectional shape of the second gap F2, the case where the surface of the outer cover 47 on the second gap F2 side is constituted by the two rectilinear surfaces (bent surface) such that the central portion thereof projects upward and includes the top 47*p* and that each of the end portions thereof inclines downward was described, but the present invention is not limited thereto. For example, as shown in part (a) of FIG. 15, the cross-sectional shape may also be such that the height of each of the end portions is substantially the same and the height of the central portion is substantially the same or, as shown in part (b) of FIG. 15, the cross-sectional shape may also be such that the height of each of the end portions is substantially the same and the central region B2 includes a top 47*p* at a center thereof with respect to the widthwise direction W. Further, in the above-described embodiments, the case where the surface of the inner cover 48 on the second gap F2 side is the single rectilinear surface was described, but the present invention is not limited thereto. Also the surface of the inner cover 48 on the second gap F2 side, similarly as in the case of the surface of the outer cover 47 on the second gap F2 side, may also have various shapes other than the rectilinear shape.

Further, the present invention is also applicable to, other than the constitution in which in the developing chamber 41*a*, the supply of the developer to the developing sleeve 44 and collection of the developer from the developing sleeve 44 are carried out as described above. For example, with reference to FIG. 3, even a constitution such that the developer is supplied from the developing chamber 41*a* to the developing sleeve 44 and the developer peeled off the developing device 44 is collected by the stirring chamber 41*b* is employed, the present invention is applicable thereto.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-068772 filed on Mar. 30, 2017 and 2017-068780 filed on Mar. 30, 2017, which are hereby incorporated by reference herein in their entirety.

What is claimed is:

1. A developing device comprising:

an accommodating casing configured to accommodate a developer;

a rotatable developer carrying member provided in said accommodating casing and configured to develop, in a developing region, an electrostatic latent image formed on an image bearing member;

a regulating portion provided below said developer carrying member with respect to a vertical direction and configured to regulate an amount of the developer on said developer carrying member;

a magnetic flux generating portion provided inside said developer carrying member and including a first magnetic pole provided downstream of the developing region with respect to a rotational direction of said developer carrying member and a second magnetic pole which is provided adjacently downstream of said first magnetic pole with respect to the rotational direction and which has a polarity identical to a polarity of said first magnetic pole; and a cover portion provided downstream of the developing region and upstream of a maximum magnetic flux density position of said second magnetic pole with respect to the rotational direction, said cover portion being disposed between said casing and said developer carrying member over a rotational axis direction of said developer carrying member with a gap between itself and said casing and with a gap between itself and said developer carrying member, wherein as measured in the rotational axis direction, a dimension of said cover portion at an upstream end with respect to the rotational direction is smaller than a dimension of said cover portion in at least a region positioned downstream of the upstream end with respect to the rotational direction.

2. A developing device according to claim 1, wherein the region is a downstream end of said cover portion with respect to the rotational direction.

3. A developing device according to claim 1, wherein the upstream end extends along said developer carrying member to a position opposing the image bearing member.

4. A developing device according to claim 1, wherein an opposing region where an inner surface of said accommodating casing and said developer carrying member oppose each other is provided downstream of the developing region and upstream of the upstream end with respect to the rotational direction.

5. A developing device according to claim 1, wherein the width of said cover portion with respect to the rotational axis direction gradually decreases from a downstream end toward the upstream end of said cover portion with respect to the rotational direction.

6. A developing device according to claim 1, wherein a minimum of the gap between said cover portion and said accommodating casing at the upstream end is larger than a minimum of the gap between said cover portion and said accommodating casing in the region.

7. A developing device according to claim 1, wherein the width of said cover portion with respect to the rotational axis direction is larger than a width, with respect to the rotational axis direction, of a region where said developer carrying member carries the developer.

8. A developing device comprising:

an accommodating casing configured to accommodate a developer;

a rotatable developer carrying member provided in said accommodating casing and configured to develop, in a developing region, an electrostatic latent image formed on an image bearing member;

a regulating portion provided below said developer carrying member with respect to a vertical direction and configured to regulate an amount of the developer on said developer carrying member;

a magnetic flux generating portion provided inside said developer carrying member and including a first magnetic pole provided downstream of the developing region with respect to a rotational direction of said developer carrying member and a second magnetic pole which is provided adjacently downstream of said first magnetic pole with respect to the rotational direction and which has a polarity identical to a polarity of said first magnetic pole; and a cover portion provided downstream of the developing region and upstream of a maximum magnetic flux density position of said second magnetic pole with respect to the rotational direction, said cover portion being disposed between said casing and said developer carrying member over a rotational axis direction of said developer carrying member with a gap between itself and said casing and with a gap between itself and said developer carrying member, wherein a shortest distance between said cover portion and said accommodating casing at a central portion of a downstream end of said cover portion positioned on a downstream side of said cover portion with respect to the rotational direction is larger than a shortest distance between said cover portion and said accommodating casing in a region, of said cover portion, positioned outside the central portion of the downstream end with respect to the rotational axis direction.

9. A developing device according to claim 8, wherein the region is positioned outside a region where said developer carrying member carries the developer.

10. A developing device according to claim 8, wherein an opposing region where an inner surface of said accommodating casing and said developer carrying member oppose each other is provided downstream of the developing region and upstream of an upstream end of said cover portion with respect to the rotational direction.

11. A developing device according to claim 8, wherein an upstream end of said cover portion extends along said developer carrying member to a position opposing the image bearing member.

12. A developing device according to claim 8, wherein a shortest distance between said cover portion and said accommodating casing at a central portion of an upstream end of said cover portion positioned on an upstream side of said cover portion with respect to the rotational direction is larger than a shortest distance between said cover portion and said accommodating casing in a region, of said cover portion, positioned outside the central portion of the upstream end with respect to the rotational axis direction.

13. A developing device comprising:

an accommodating casing configured to accommodate a developer;

a rotatable developer carrying member provided in said accommodating casing and configured to develop, in a developing region, an electrostatic latent image formed on an image bearing member;

a regulating portion provided below said developer carrying member with respect to a vertical direction and configured to regulate an amount of the developer on said developer carrying member;

a magnetic flux generating portion provided inside said developer carrying member and including a first magnetic pole provided downstream of the developing region with respect to a rotational direction of said developer carrying member and a second magnetic pole which is provided adjacently downstream of said first magnetic pole with respect to the rotational direction and which has a polarity identical to a polarity of said first magnetic pole; and a cover portion provided downstream of the developing region and upstream of a maximum magnetic flux density position of said second magnetic pole with respect to the rotational direction, said cover portion being disposed between said casing and said developer carrying member over a rotational axis direction of said developer carrying member with a gap between itself and said casing and with a gap between itself and said developer carrying member, wherein a shortest distance between said cover portion and said accommodating casing at a central portion of an upstream end of said cover portion positioned on a upstream side of said cover portion with respect to the rotational direction is larger than a shortest distance between said cover portion and said accommodating casing in a region, of said cover portion, positioned outside the central portion of the upstream end with respect to the rotational axis direction.

14. A developing device according to claim 13, wherein the region is positioned outside a region where said developer carrying member carries the developer.

15. A developing device according to claim 13, wherein an opposing region where an inner surface of said accommodating casing and said developer carrying member oppose each other is provided downstream of the developing region and upstream of an upstream end of said cover portion with respect to the rotational direction.

16. A developing device according to claim 13, wherein an upstream end of said cover portion extends along said developer carrying member to a position opposing the image bearing member.

* * * * *